US010161659B2

(12) United States Patent
Ishizaka et al.

(10) Patent No.: US 10,161,659 B2
(45) Date of Patent: Dec. 25, 2018

(54) REFRIGERANT EVAPORATOR

(71) Applicant: DENSO CORPORATION, Kariya, Aichi-pref. (JP)

(72) Inventors: Naohisa Ishizaka, Kariya (JP); Tatsuhiko Nishino, Kariya (JP); Shota Chatani, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 316 days.

(21) Appl. No.: 14/890,689

(22) PCT Filed: May 16, 2014

(86) PCT No.: PCT/JP2014/002590
§ 371 (c)(1),
(2) Date: Nov. 12, 2015

(87) PCT Pub. No.: WO2014/188689
PCT Pub. Date: Nov. 27, 2014

(65) Prior Publication Data

US 2016/0102893 A1 Apr. 14, 2016

(30) Foreign Application Priority Data

May 20, 2013 (JP) ..... 2013-106144
May 24, 2013 (JP) ..... 2013-110056

(51) Int. Cl.
*F25B 39/02* (2006.01)
*F25B 39/00* (2006.01)
(Continued)

(52) U.S. Cl.
CPC ..... *F25B 39/00* (2013.01); *F25B 39/02* (2013.01); *F28D 1/05391* (2013.01);
(Continued)

(58) Field of Classification Search
CPC ..... F25B 39/00; F25B 39/02; F28D 1/05391; F28D 2021/0071; F28D 1/05333;
(Continued)

(56) References Cited

U.S. PATENT DOCUMENTS

2004/0159121 A1 8/2004 Horiuchi et al.
2004/0206490 A1 10/2004 Katoh et al.
(Continued)

FOREIGN PATENT DOCUMENTS

JP S6196189 U 6/1986
JP S63003153 A 1/1988
(Continued)

OTHER PUBLICATIONS

International Search Report and Written Opinion (in Japanese with English Translation) for PCT/JP2014/002590, dated Aug. 5, 2014; ISA/JP.

*Primary Examiner* — Joseph Trpisovsky
(74) *Attorney, Agent, or Firm* — Harness, Dickey & Pierce, P.L.C.

(57) ABSTRACT

A first evaporation unit and a second evaporation unit are coupled via a refrigerant interchanging portion having a first communication portion and a second communication portion. A first partition member is provided in a tank portion of the first evaporation unit to define a first tank internal space and a second tank internal space. The first partition member has a first communication hole to let the first tank internal space and the second tank internal space communicate with each other. A second partition member is provided in a tank portion of the second evaporation unit to define a third tank internal space and a fourth tank internal space. The second partition member has a second communication hole to let the third tank internal space and the fourth tank internal space communicate with each other.

9 Claims, 15 Drawing Sheets

(51) Int. Cl.
*F28F 9/02* (2006.01)
*F28D 1/053* (2006.01)
*F28D 21/00* (2006.01)

(52) U.S. Cl.
CPC ..... *F28F 9/0212* (2013.01); *F28F 9/0265* (2013.01); *F28D 2021/0071* (2013.01)

(58) Field of Classification Search
CPC ..... F28D 1/0435; F28F 9/0212; F28F 9/0265; F28F 9/02; F28F 9/0262; F28F 9/0243
USPC ..... 62/525
See application file for complete search history.

(56) References Cited

U.S. PATENT DOCUMENTS

| | | | |
|---|---|---|---|
| 2005/0235691 | A1 | 10/2005 | Katoh et al. |
| 2006/0162918 | A1 | 7/2006 | Horiuchi et al. |
| 2006/0213651 | A1 | 9/2006 | Higashiyama et al. |
| 2007/0074861 | A1 | 4/2007 | Higashiyama |
| 2007/0158057 | A1 | 7/2007 | Higashiyama |
| 2010/0031698 | A1 | 2/2010 | Higashiyama |
| 2015/0027163 | A1 | 1/2015 | Ishizaka et al. |

FOREIGN PATENT DOCUMENTS

| | | | |
|---|---|---|---|
| JP | H08136182 | A | 5/1996 |
| JP | 2001255095 | A | 9/2001 |
| JP | 2005043040 | A | 2/2005 |
| JP | 2005241170 | A | 9/2005 |
| JP | 2006029697 | A | 2/2006 |
| JP | 2006170598 | A | 6/2006 |
| JP | 4024095 | B2 | 12/2007 |
| JP | 2007327664 | A | 12/2007 |
| JP | 4106998 | B2 | 6/2008 |
| JP | 4120611 | B2 | 7/2008 |
| JP | 4124136 | B2 | 7/2008 |
| JP | 4207855 | B2 | 1/2009 |
| JP | 2010-038447 | A | 2/2010 |
| JP | 4554144 | B2 | 9/2010 |
| JP | 4625687 | B2 | 2/2011 |
| JP | 2012032112 | A | 2/2012 |
| JP | 2013096653 | A | 5/2013 |

REFRIGERANT EVAPORATOR

CROSS REFERENCE TO RELATED APPLICATIONS

This application is a U.S. National Phase Application under 35 U.S.C. 371 of International Application No. PCT/JP2014/002590 filed on May 16, 2014 and published in Japanese as WO 2014/188689 A1 on Nov. 27, 2014. This application is based on and claims the benefit of priority from Japanese Patent Application No. 2013-106144 filed on May 20, 2013 and Japanese Patent Application No. 2013-110056 filed on May 24, 2013. The entire disclosures of all of the above applications are incorporated herein by reference.

TECHNICAL FIELD

The present disclosure relates to a refrigerant evaporator.

BACKGROUND ART

A refrigerant evaporator functions as a cooling heat exchanger that cools fluid (for example, air) flowing outside by evaporating refrigerant (liquid phase refrigerant) flowing inside to absorb heat from the fluid.

A refrigerant evaporator includes first and second evaporation units, each of which has a heat-exchanging core portion formed by stacking multiple tubes and a pair of tank portions connected to both ends of the multiple tubes. The first and second evaporation units are disposed in series in a flow direction of the fluid, and first tank portions of the respective evaporation units are coupled to each other via communication portions (see, for example, PTL 1 and PTL 2).

The refrigerant evaporator of PTL 1 and PTL 2 is configured in such a manner that when refrigerant that has flowed the heat-exchanging core portion of the first evaporation unit is made to flow into the heat-exchanging core portion of the second evaporation unit via the first tank portions of the respective evaporation units and a pair of the communication portions coupling the first tank portions, flows of the refrigerant are interchanged in a width direction (right-left direction) of the heat-exchanging core portions. In other words, the refrigerant evaporator is configured in such a manner that the refrigerant flowing the heat-exchanging core portion of the first evaporation unit on one side in the width direction is made to flow into the heat-exchanging core portion of the second evaporator portion on the other side in the width direction using one of the pair of communication portions, while the refrigerant flowing the heat-exchanging core portion of the first evaporation unit on the other side in the width direction is made to flow into the heat-exchanging core portion of the second evaporation unit on the one side in the width direction using the other communication portion.

The refrigerant evaporator described in PTL 1 enhances distribution of the refrigerant in the heat-exchanging core portion of the second evaporation unit by providing a partition plate inside an upper tank portion of a windward evaporation unit disposed on an upstream side in a flow direction of the fluid to divide a tank interior in a top-down direction and by providing the partition plate with through-holes.

Regarding the refrigerant evaporator described in PTL 2, let AA be a refrigerant channel through which a refrigerant flowing the heat-exchanging core portion of the first evaporation unit on one side in the width direction is passed to the heat-exchanging core portion of the second evaporation unit so as to flow on the other side in the width direction, and BB be a refrigerant channel through which a refrigerant flowing the heat-exchanging core portion of the first evaporation unit on the other side in the width direction is passed to the heat-exchanging core portion of the second evaporation unit so as to flow on one side in the width direction. Then, during a low flow rate operation during which a flow rate of refrigerant circulating in the refrigeration cycle is low, a case where an entire liquid phase refrigerant flows the refrigerant channel AA whereas the liquid phase refrigerant does not flow the refrigerant channel BB at all may possibly occur.

In such a case, because the liquid phase refrigerant flows the refrigerant channel AA, the liquid phase refrigerant flows the heat-exchanging core portion of the first evaporation unit on one side in the width direction and the heat-exchanging core portion of the second evaporation unit on the other side in the width direction. Hence, when the refrigerant evaporator is viewed in a flow direction of blown air, the liquid phase refrigerant flows an entire overlapping region in the heat-exchanging core portion of the first evaporation unit and the heat-exchanging core portion of the second evaporation unit.

In the refrigerant evaporator in which the liquid phase refrigerant is disturbed as above, blown air can be cooled sufficiently because the refrigerant absorbs sensible heat and latent heat from the blown air in the heat-exchanging core portion of either one of the evaporation units.

In order to distribute the liquid phase refrigerant as above during a low flow rate operation, it is necessary, in an inlet-side tank portion from which the refrigerant is distributed to the heat-exchanging core portion of the first evaporation unit, to pass the refrigerant from a refrigerant inlet portion from which refrigerant is introduced to a position opposing a boundary between two heat-exchanging core portions of the second evaporation unit (hereinafter, referred to as the boundary opposing region).

PTL 3 discloses a refrigerant evaporator that enhances distribution of a liquid phase refrigerant by providing a nozzle to a refrigerant inlet portion so as to direct the liquid phase refrigerant to an inner side (an end on the opposite side to the refrigerant inlet portion) of an inlet-side tank portion during a low flow rate operation.

PRIOR ART LITERATURES

Patent Literature

PTL 1: JP 4625687 B2
PTL 2: JP 4124136 B2
PTL 1: JP 4106998 B2

SUMMARY OF INVENTION

In the refrigerant evaporator described in PTL 1, the refrigerant flows into a leeward evaporation unit disposed on a downstream side in the flow direction of the fluid from a longitudinal end of the tank portion (in a stacking direction of tubes). Hence, the refrigerant that has flowed into the heat-exchanging core portion of the leeward evaporation unit is distributed unevenly due to influences of an inertial force of the refrigerant that has flowed inside, a gravitational force, a back pressure of tubes of the windward evaporation unit, and a distribution of the fluid in the heat-exchanging core portion of the windward evaporation unit.

For example, when a flow rate is high, that is, while a flow rate of the refrigerant circulating in a refrigeration cycle is high, a flow speed of the refrigerant is high. Hence, due to an inertial force of the refrigerant, the refrigerant hardly flows to the tubes near the refrigerant inlet portion and readily flows away from the refrigerant inlet portion. On the other hand, when a flow rate is low, that is, while a flow rate of the refrigerant circulating in the refrigeration cycle is low, a flow speed of the refrigerant is low. Hence, the refrigerant is more susceptible to a gravitational force and the refrigerant hardly flows to the tubes away from the refrigerant inlet portion and readily flows near the refrigerant inlet portion.

Hence, in the refrigerant evaporator described in the PTL 1, a biased distribution of the refrigerant occurs in the heat-exchanging core portion of the leeward evaporation unit due to a fluctuation of a flow rate of the refrigerant. Accordingly, an amount of the refrigerant supplied to two heat-exchanging core portions of the windward evaporation unit becomes unequal. Consequently, distribution of the refrigerant is deteriorated.

When the nozzle described in PTL 3 is applied to the refrigerant evaporator described in PTL 2, in order to pass the liquid phase refrigerant sufficiently to either one of the two heat-exchanging core portions of the first evaporation unit, whichever is the nearer to the refrigerant inlet portion (hereinafter, referred to as the inlet-side heat-exchanging core portion), it is necessary to direct the liquid phase refrigerant from the refrigerant inlet portion to the more inner side than the boundary opposing region.

However, when the liquid phase refrigerant is directed from the refrigerant inlet portion to the more inner side than the boundary opposing region, a flow rate of the liquid phase refrigerant flowing the inlet-side heat-exchanging core portion becomes short and a region where the liquid phase refrigerant does not flow at all is developed when the refrigerant evaporator is viewed in the flow direction of blown air. Consequently, an unwanted temperature distribution is generated in the blown air passing through the refrigerant evaporator.

The present disclosure has a first object to provide a refrigerant evaporator capable of enhancing distribution of a liquid phase refrigerant.

The present disclosure has a second object to provide a refrigerant evaporator capable of restricting a generation of a temperature distribution in blown air passing through the refrigerant evaporator when a flow rate of a refrigerant flowing a refrigeration cycle is low.

According to an aspect of the present application, a refrigerant evaporator that exchanges heat between fluid flowing outside to be cooled and refrigerant includes a first evaporation unit and a second evaporation unit disposed in series in a flow direction of the fluid. Each of the first evaporation unit and the second evaporation unit has a heat-exchanging core portion in which a plurality of tubes are stacked, the refrigerant flowing through the plurality of tubes, and a pair of tank portions connected to both ends of the plurality of tubes to collect or distribute the refrigerant flowing through the plurality of tubes. The heat-exchanging core portion of the first evaporation unit has a first core portion defined by a part of the plurality of tubes and a second core portion defined by a rest of the plurality of tubes. The heat-exchanging core portion of the second evaporation unit has a third core portion defined by a part of the plurality of tubes opposing at least a part of the first core portion in the flow direction of the fluid and a forth core portion defined by a part of the plurality of tubes opposing at least a part of the second core portion in the flow direction of the fluid. Of the pair of tank portions of the first evaporation unit, one tank portion includes a first refrigerant collection portion to collect the refrigerant from the first core portion and a second refrigerant collection portion to collect the refrigerant from the second core portion. Of the pair of tank portions of the second evaporation unit, one tank portion includes a first refrigerant distribution portion to distribute the refrigerant to the third core portion and a second refrigerant distribution portion to distribute the refrigerant to the fourth core portion. The first evaporation unit and the second evaporation unit are coupled via a refrigerant interchanging portion having a first communication portion that introduces refrigerant from the first refrigerant collection portion to the second refrigerant distribution portion and a second communication portion that introduces refrigerant from the second refrigerant collection portion to the first refrigerant distribution portion.

Of the pair of tank portions of the first evaporation unit, the other tank portion includes a first partition member that divides a tank internal space of the other tank portion to a first tank internal space and a second tank internal space in a longitudinal direction of the tube. The first partition member has a first communication hole to let the first tank internal space and the second tank internal space communicate with each other. Of the pair of tank portions of the second evaporation unit, the other tank portion includes a second partition member that divides a tank internal space of the other tank portion to a third tank internal space and a fourth tank internal space in a longitudinal direction of the tube. The second partition member has a second communication hole to let the third tank internal space and the fourth tank internal space communicate with each other.

The first communication hole and the second communication hole are disposed asymmetrically with respect to a virtual line perpendicular to the flow direction of the fluid and passing a center between the other tank portion of the first evaporation unit and the other tank portion of the second evaporation unit.

By providing the first partition member with the first communication hole to let the first tank internal space and the second tank internal space communicate with each other and providing the second partition member with the second communication hole to let the third tank internal space and the fourth tank internal space communicate with each other while disposing the first communication hole and the second communication hole asymmetrically with respect to the virtual line passing a center between the other tank portion of the first evaporation unit and the other tank portion of the second evaporation unit and orthogonal to the flow direction of the fluid, a pressure loss can be made uniform in the tubes of the entire overlapping region in the heat-exchanging core portion of the first evaporation unit and the heat-exchanging core portion of the second evaporation unit overlap with each other when the refrigerant evaporator is viewed in the flow direction of the fluid.

Hence, distribution of the liquid phase refrigerant in the heat-exchanging core portions can be enhanced. Consequently, a temperature distribution generated in blown air passing through the refrigerant evaporator can be restricted when a flow rate of a refrigerant flowing a refrigeration cycle is low.

The first evaporation unit has a refrigerant inlet portion through which refrigerant is introduced into the other tank portion of the first evaporation unit at an end of the other tank portion in a stacking direction of the tubes.

The other tank portion of the first evaporation unit includes a dam portion to hold back a flow of liquid phase refrigerant that has flowed into the other tank portion from the refrigerant inlet portion. The dam portion is disposed at a position to overlap a boundary between the third core portion and the fourth core portion of the second evaporation unit when viewed in the flow direction of the fluid.

By providing the dam portion inside the other tank portion of the first evaporation unit to hold back a flow of the liquid phase refrigerant that has flowed into the other tank portion from the refrigerant inlet portion, even when a flow rate of the refrigerant flowing the refrigeration cycle is low, the liquid phase refrigerant can be let into the tubes disposed between the refrigerant inlet portion and the dam portion in a reliable manner.

By disposing the dam portion at a position so as to overlap the boundary between the third core portion and the fourth core portion of the second evaporation unit when viewed in the flow direction of the fluid, the liquid phase refrigerant can be passed to either the third core portion or the fourth core portion of the second evaporation unit, whichever does not oppose the tubes disposed between the refrigerant inlet portion and the dam portion.

Hence, when the refrigerant evaporator is viewed in the flow direction of the fluid, the liquid phase refrigerant can be passed across the entire overlapping region in the heat-exchanging core portions of the first evaporation unit and the second evaporation unit. Consequently, when a flow rate of the refrigerant flowing the refrigeration cycle is low, an inconvenience that a temperature distribution is generated in blown air passing through the refrigerant evaporator can be restricted.

DESCRIPTION OF EMBODIMENTS

Figure 1:
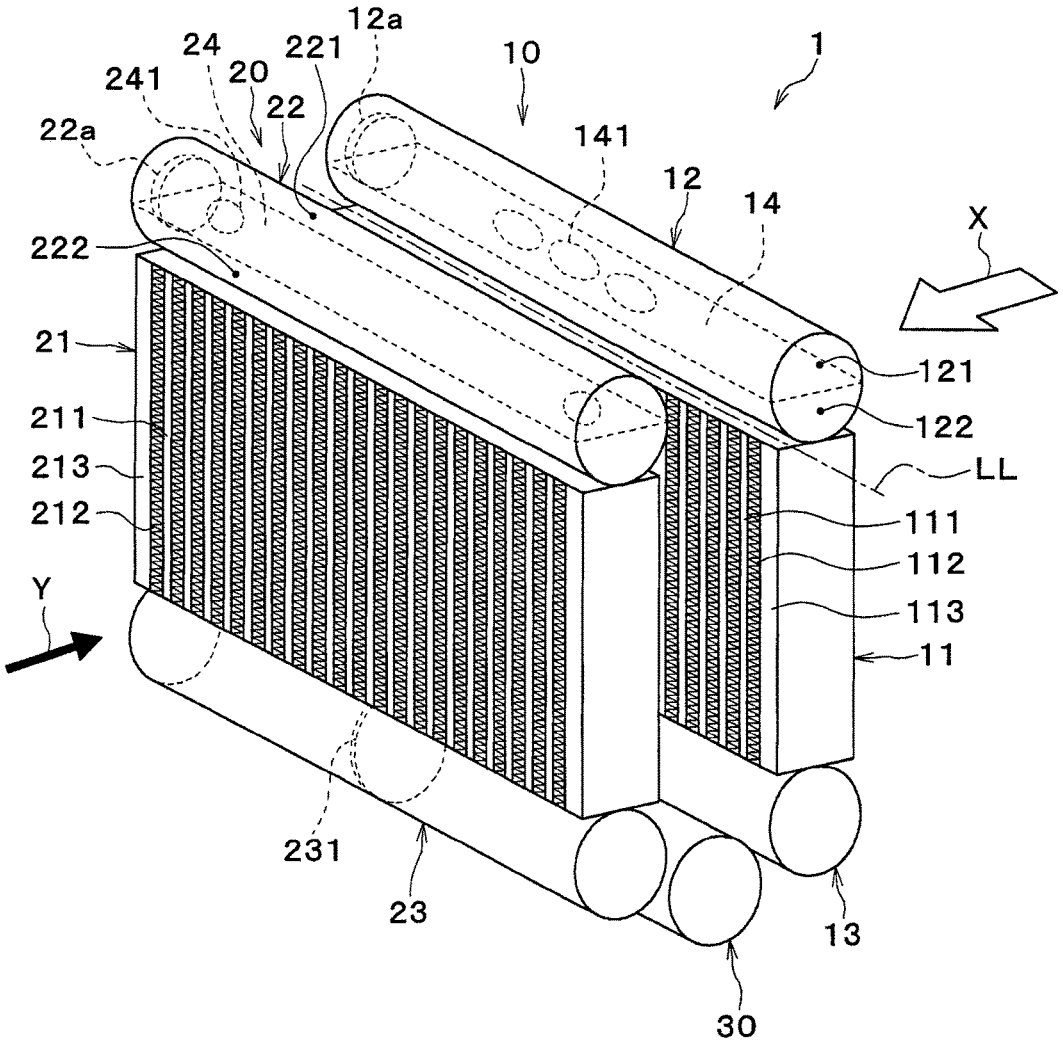
FIG. 1 is a schematic perspective view of a refrigerant evaporator according to a first embodiment.

Embodiments of the present disclosure will be described according to the drawings. Hereinafter, same or equivalent portions among the respective embodiments will be labeled with same reference numerals.

First Embodiment

A first embodiment will be described using FIG. 1 through FIG. 7. A refrigerant evaporator 1 of the present embodiment is a cooling heat exchanger which is applied to a vapor compression refrigerating cycle in an air conditioner for a vehicle to adjust a temperature in the vehicle interior and cools blown air to be blown into the vehicle interior by absorbing heat from the blown air and letting refrigerant (liquid phase refrigerant) evaporate. In the present embodiment, the blown air corresponds to "a fluid flowing outside to be cooled".

The refrigerating cycle is known to include the refrigerant evaporator 1 as well as components unillustrated herein, such as a compressor, a radiator (condenser), and an expansion valve. In the present embodiment, the refrigerating cycle is formed as a receiver cycle in which a liquid receiver is disposed between the radiator and the expansion valve. The refrigerant in the refrigeration cycle is mixed with refrigerant oil to supply lubrication for the compressor, and a part of the refrigerant oil circulates in the cycle with the refrigerant.

Here, in FIG. 2, tubes 111, 211 and fins 112, 212 are not illustrated in each heat-exchanging core portion 11, 21 to be described below.

Figure 2:
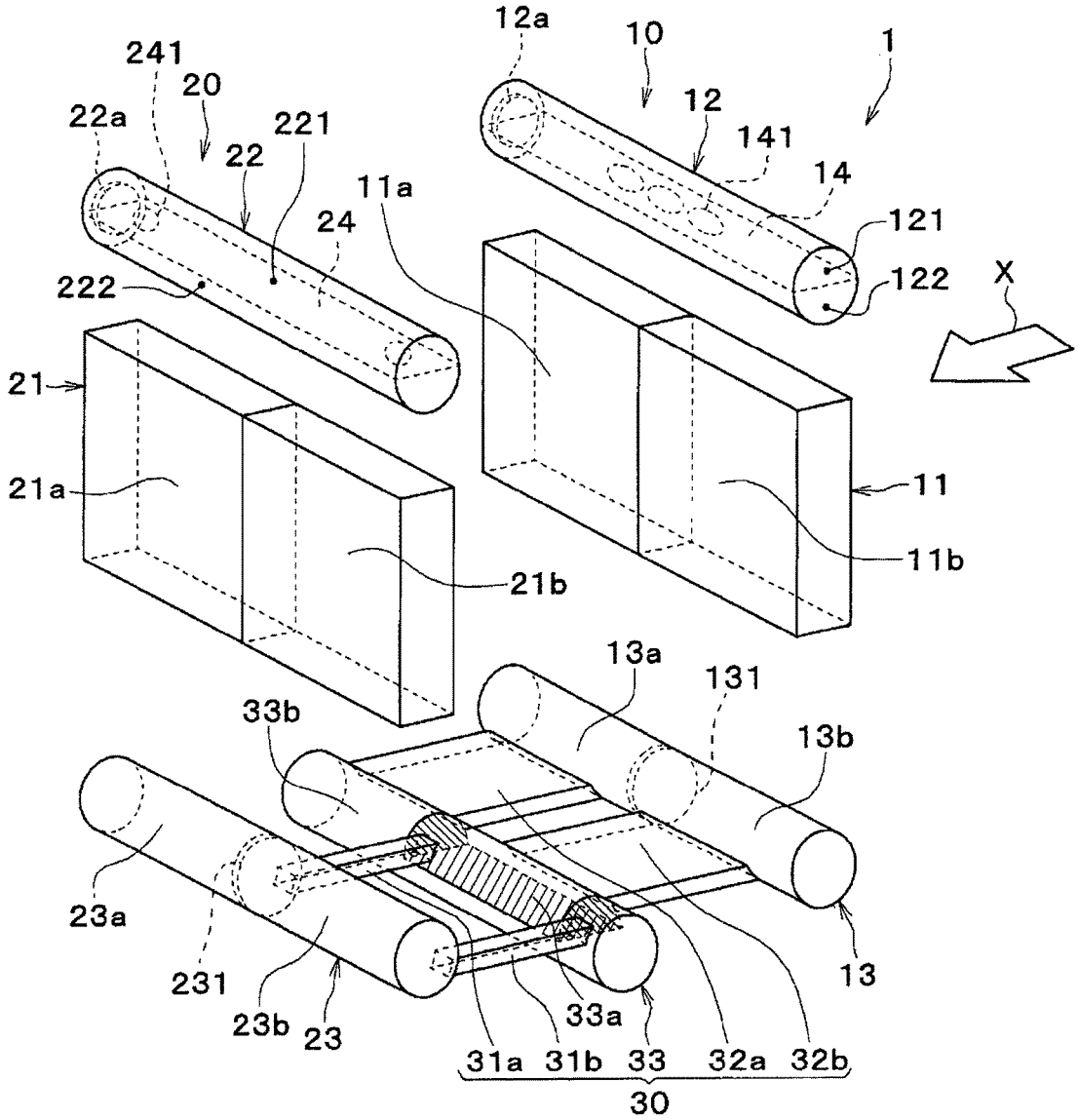
FIG. 2 is an exploded perspective view of the refrigerant evaporator shown in FIG. 1.

As shown in FIG. 1 and FIG. 2, the refrigerant evaporator 1 of the present embodiment includes two evaporation units 10 and 20 disposed in series in a flow direction of blown air (a flow direction of the fluid) X. In the present embodiment, one of the two evaporation units 10 and 20 disposed on a windward side (upstream side) in the flow direction X of blown air is referred to as the windward evaporation unit 10, and the other evaporation unit disposed on a leeward side (downstream side) in the flow direction X of blown air is referred to as the leeward evaporation unit 20. The windward evaporation unit 10 and the leeward evaporation unit 20 of the present embodiment form "a second evaporation unit" and "a first evaporation unit", respectively.

The windward evaporation unit 10 and the leeward evaporation unit 20 are of a same fundamental structure. The windward evaporation unit 10 has a heat-exchanging core portion 11 and a pair of tank portions 12 and 13 disposed, respectively, on upper and lower sides of the heat-exchanging core portion 11. Likewise, the leeward evaporation unit 20 has a heat-exchanging core portion 21 and a pair of tank portions 22 and 23 disposed, respectively, on upper and lower sides of the heat-exchanging core portion 21.

In the present embodiment, the heat-exchanging core portion of the windward evaporation unit 10 is referred to as the windward heat-exchanging core portion 11 and the heat-exchanging core portion of the leeward evaporation unit 20 is referred to as the leeward heat-exchanging core portion 21. In a pair of the tank portions 12 and 13 of the windward evaporation unit 10, the tank portion disposed on the upper side is referred to as the first windward tank portion 12 and the tank portion disposed on the lower side is referred to as the second windward tank portion 13. Likewise, in a pair of the tank portions 22 and 23 of the leeward evaporation unit 20, the tank portion disposed on the upper side is referred to as the first leeward tank portion 22 and the tank portion disposed on the lower side is referred to as the second leeward tank portion 23.

The windward heat-exchanging core portion 11 and the leeward heat-exchanging core portion 21 of the present embodiment are formed of stacked bodies. The windward heat-exchanging core portion 11 is formed by alternately stacking multiple tubes 111 extending in a top-to-bottom direction and fins 112 bonded between the adjacent tubes 111. Likewise, the leeward heat-exchanging core portion 21 is formed by alternately stacking multiple tubes 211 extending in the top-to-bottom directions and fins 112 bonded between the adjacent tubes 211. Hereinafter, a stacking direction of the stacked bodies formed of the multiple tubes 111 and 211 and the fins 112, 212 is referred to as the tube stacking direction. A longitudinal direction of the tube 111, 212 is referred to as the tube longitudinal direction.

In the present embodiment, the longitudinal direction of the tubes 111 and 211 are parallel to a vertical direction and the tube stacking direction is parallel to a horizontal direction.

The windward heat-exchanging core portion 11 has a first windward heat-exchanging core portion 11*a* defined by a part of tube groups of the multiple tubes 111 and a second windward heat-exchanging core portion 11*b* defined by the rest of the tube groups of the multiple tubes 111. The first windward heat-exchanging core portion 11*a* and the second windward heat-exchanging core portion 11*b* of the present embodiment form "a third core portion" and "a fourth core portion", respectively.

In the present embodiment, when the windward heat-exchanging core portion 11 is viewed in the flow direction of blown air, the first windward heat-exchanging core portion 11*a* is defined by tube groups on a right side in the tube stacking direction while the second windward heat-exchanging core portion 11*b* is defined by the tube groups on a left side in the tube stacking direction.

Also, the leeward heat-exchanging core portion 21 has a first leeward heat-exchanging core portion 21*a* defined by a part of tube groups of the multiple tubes 211 and a second leeward heat-exchanging core portion 21*b* defined by the rest of the tube groups of the multiple tubes 211. The first leeward heat-exchanging core portion 21*a* and the second leeward heat-exchanging core portion 21*b* of the present embodiment form "a first core portion" and "a second core portion", respectively.

In the present embodiment, when the leeward heat-exchanging core portion 21 is viewed in the flow direction of blown air, the first leeward heat-exchanging core portion 21*a* is defined by tube groups on a right side in the tube stacking direction while the second leeward heat-exchanging core portion 21*b* is defined by the tube groups on a left side in the tube stacking direction. In the present embodiment, when viewed in the flow direction of blown air, the first windward heat-exchanging core portion 11*a* and the first leeward heat-exchanging core portion 21*a* are disposed to overlap (oppose) with each other, while the second windward heat-exchanging core portion 11*b* and the second leeward heat-exchanging core portion 21*b* are disposed to overlap (oppose) with each other.

Each of the tubes 111, 211 is formed of a flat tube, inside of which a refrigerant passage is defined for the refrigerant to flow and which has a flat sectional shape extending along the flow direction of blown air.

The tubes 111 of the windward heat-exchanging core portion 11 are connected to the first windward tank portion 12 at one ends (upper ends) in a longitudinal direction and connected to the second windward tank portion 13 at the other ends (lower ends) in the longitudinal direction. Also, the tubes 211 of the leeward heat-exchanging core portion 21 are connected to the first leeward tank portion 22 at one ends (upper ends) in the longitudinal direction and connected to the second leeward tank portion 23 at the other ends (lower ends) in the longitudinal direction.

Each fin 112, 212 is a corrugate fin formed of a thin plate material folded in a wavy shape. The fins 112, 212 are bonded to flat outer surfaces of the respective tubes 111, 211 and function as heat-exchange facilitating member for increasing a heat-transfer area between the blown air and the refrigerant.

Side plates 113, 213 to reinforce the respective heat-exchanging core portions 11, 21 are disposed to the respective stacked bodies formed of the tubes 111, 211 and the fins 112, 212 at both ends in the tube stacking direction. The side plates 113, 213 are bonded to the fins 112, 212 disposed on outermost sides in the tube stacking direction.

The first leeward tank portion 22 is formed of a tube-like member which is closed at one end and provided with a refrigerant inlet portion 22*a* at the other end. The refrigerant inlet portion 22*a* introduces low-pressure refrigerant compressed by the compressor (not shown) into the tank portion. The first leeward tank portion 22 has through-holes (not shown) in a bottom portion for the one ends (upper ends) of the respective tubes 211 to be inserted and bonded. In other words, the first leeward tank portion 22 is formed in such a manner that an internal space communicates with the respective tubes 211 of the leeward heat-exchanging core portion 21, and functions as a refrigerant distribution portion that distributes the refrigerant to the respective core portions 21*a* and 21*b* of the leeward heat-exchanging core portion 21.

A first partition member 24 is disposed inside the first leeward tank portion 22 at a region opposite from the leeward heat-exchanging core portion 21 through the ends of the tubes 211 in the longitudinal direction. The first partition member 24 divides a tank internal space to two in the tube longitudinal direction, namely a first tank internal space 221 and a second tank internal space 222. In the present embodiment, the first partition member 24 is disposed inside the first leeward tank portion 22 at a center position in the tube longitudinal direction.

The first partition member 24 has multiple first communication holes 241 to let the first tank internal space 221 and the second tank internal space 222 communicate with each other. In the present embodiment, two first communication holes 241 are provided, that is, one in the vicinity of each end of the first partition member 24 in the tube stacking direction.

A partition member 231 is disposed inside the second leeward tank portion 23 at a center position in the longitudinal direction. The partition member 231 divides a tank internal space to a space with which the respective tubes 211 making up the first leeward heat-exchanging core portion 21*a* communicate and a space with which the respective tubes 211 making up the second leeward heat-exchanging core portion 21*b* communicate.

In the interior of the second leeward tank portion 23, the space communicating with the respective tubes 211 making up the first leeward heat-exchanging core portion 21*a* forms a first refrigerant collection portion 23*a* that collects the refrigerant from the first leeward heat-exchanging core portion 21*a*, and the space communicating with the respective tubes 211 making up the second leeward heat-exchanging core portion 21*b* forms a second refrigerant collection portion 23*b* that collects the refrigerant from the second leeward heat-exchanging core portion 21*b*.

The first windward tank portion 12 is formed of a tube-like member which is closed at one end (a left end when viewed in the flow direction of blown air) and provided with a refrigerant outlet portion 12*a* at the other end (a right end when viewed in the flow direction of blown air). The refrigerant outlet portion 12*a* is to introduce the refrigerant in the tank to a drawing side of the compressor (not shown). The first windward tank portion 12 is provided with through-holes (not shown) in a bottom portion for the one ends (upper ends) of the respective tubes 111 to be inserted and bonded. In other words, the first windward tank portion 12 is formed in such a manner that an internal space communicates with the respective tubes 111 of the windward heat-exchanging core portion 11, and functions as a refrigerant collection portion that collects the refrigerant from the respective core portions 11*a* and 11*b* of the windward heat-exchanging core portion 11.

A second partition member 14 is disposed inside the first windward tank portion 12 at a region opposite from the windward heat-exchanging core portion 11 through the ends of the tubes 111 in the longitudinal direction. The second partition member 14 divides a tank internal space to two in the tube longitudinal direction, namely a third tank internal space 121 and a fourth tank internal space 122. In the present embodiment, the second partition member 14 is disposed inside the first windward tank portion 12 at a center position in the tube longitudinal direction (top-bottom direction of FIG. 1).

The second partition member 14 has multiple second communication holes 141 to let the third tank internal space 121 and the fourth tank internal space 122 communicate with each other. In the present embodiment, three second through-holes 141 are provided at or near a center of the second partition member 14 in the tube stacking direction. A hole diameter of the second through-hole 141 is larger than a hole diameter of the first through-hole 241.

The first communication holes 241 and the second communication holes 141 are disposed asymmetrically with respect to a virtual line LL passing a center between the first leeward tank portion 22 and the first windward tank portion 12 and orthogonal to the flow direction X of blown air. More specifically, the first communication holes 241 and the second communication holes 141 are disposed at positions so as not to overlap when viewed in the flow direction X of blown air.

In the present embodiment, a total area of the multiple second communication holes 141 provided to the second partition member 14 is larger than a total area of the multiple first communication holes 241 provided to the first partition member 24. An area of each second communication hole 141 is larger than an area of each first communication hole 241.

The second windward tank portion 13 is formed of a tube-like member closed at both ends. The second windward tank portion 13 is provided with through-holes (not shown) in a ceiling portion for the other ends (lower ends) of the respective tubes 111 to be inserted and bonded. In other words, the second windward tank portion 13 is formed in such a manner that an internal space communicates with the respective tubes 111.

A partition member 131 is disposed inside the second windward tank portion 13 at a center position in the longitudinal direction. The partition member 131 divides a tank internal space to a space with which the respective tubes 111 making up the first windward heat-exchanging core portion 11*a* communicate, and a space with which the respective tubes 111 making up the second windward heat-exchanging core portion 11*b* communicate.

In the interior of the second windward tank portion 13, the space communicating with the respective tubes 111 making up the first windward heat-exchanging core portion 11*a* forms a first refrigerant distribution portion 13*a* that distributes the refrigerant to the first windward heat-exchanging core portion 11*a*, and the space communicating with the respective tubes 111 making up the second windward heat-exchanging core portion 11*b* forms a second refrigerant distribution portion 13*b* that distributes the refrigerant to the second windward heat-exchanging core portion 11*b*.

The second leeward tank portion 23 is formed of a tube-like member closed at both ends. The second leeward tank portion 23 is provided with through-holes (not shown) in a ceiling portion for the other ends (lower ends) of the respective tubes 211 to be inserted and bonded. In other words, the second leeward tank portion 23 is formed in such a manner that an internal space communicates with the respective tubes 211.

The second windward tank portion 13 and the second leeward tank portion 23 are coupled to each other via a refrigerant interchanging portion 30. The refrigerant interchanging portion 30 is configured so as to introduce the refrigerant in the first refrigerant collection portion 23*a* of the second leeward tank portion 23 to the second refrigerant distribution portion 13*b* of the second windward tank portion 13 and also to introduce the refrigerant in the second refrigerant collection portion 23*b* of the second leeward tank portion 23 to the first refrigerant distribution portion 13*a* of the second windward tank portion 13. In short, the refrigerant interchanging portion 30 is configured so as to interchange flows of the refrigerant in the core width direction in the respective heat-exchanging core portions 11 and 21.

More specifically, the refrigerant interchanging portion 30 includes a pair of collection connectors 31*a* and 31*b* which are coupled, respectively, to the first and second refrigerant collection portions 23*a* and 23*b* of the second leeward tank portion 23, a pair of distribution connectors 32*a* and 32*b* which are coupled, respectively, to the refrigerant distribution portions 13*a* and 13*b* of the second windward tank portion 13, and an intermediate tank portion 33 coupled to each of the collection connectors 31*a* and 31*b* and each of the distribution connectors 32*a* and 32*b*.

Each of the collection connectors 31*a* and 31*b* in a pair is formed of a tube-like member, within which a refrigerant channel to pass the refrigerant is defined. One end of each is connected to the second leeward tank portion 23 and the other end is connected to the intermediate tank portion 33.

One of the collection connectors 31*a* and 31*b* is referred to as a first collection connector 31*a*, which is connected to the second leeward tank portion 23 at one end so as to communicate with the first refrigerant collection portion 23*a* and connected to the intermediate tank portion 33 at the other end so as to communicate with a first refrigerant channel 33*a* in the intermediate tank portion 33 described below.

The other one is referred to as a second collection connector 31*b*, which is connected to the second leeward tank portion 23 at one end so as to communicate with the second refrigerant collection portion 23*b* and connected to the intermediate tank portion 33 at the other end so as to communicate with a second refrigerant channel 33*b* in the intermediate tank portion 33 described below.

In the present embodiment, the one end of the first collection connector 31*a* is connected to the first refrigerant collection portion 23*a* at a position nearer to the partition member 231 and the one end of the second collection connector 31*b* is connected to the second refrigerant collection portion 23*b* at a position nearer to the closed end of the second leeward tank portion 23.

Each of the distribution connectors 32*a* and 32*b* in a pair is formed of a tube-like member, within which a refrigerant channel to pass the refrigerant is defined. One end of each is connected to the second windward tank portion 13 and the other end is connected to the intermediate tank portion 33.

One of the distribution connectors 32*a* and 32*b* is referred to as a first distribution connector 32*a*, which is connected to the second windward tank portion 13 at one end so as to communicate with the first refrigerant distribution portion 13*a* and connected to the intermediate tank portion 33 at the other end so as to communicate with the second refrigerant channel 33*b* in the intermediate tank portion 33 described below. In short, the first distribution connector 32*a* communicates with the second collection connector 31*b* via the second refrigerant channel 33*b* in the intermediate tank portion 33.

The other one is referred to as a second distribution connector 32*b*, which is connected to the second windward tank portion 13 at one end so as to communicate with the second refrigerant distribution portion 13*b* and connected to the intermediate tank portion 33 at the other end so as to communicate with the first refrigerant channel 33*a* in the intermediate tank portion 33 described below. In short, the second distribution connector 32*b* communicates with the first collection connector 31*a* via the first refrigerant channel 33*a* in the intermediate tank portion 33.

In the present embodiment, the one end of the first distribution connector 32*a* is connected to the first refrigerant distribution portion 13*a* at a position nearer to the closed end of the second windward tank portion 13 and the one end of the second distribution connector 32*b* is connected to the second refrigerant distribution portion 13*b* at a position nearer to the partition member 131.

Each of the collection connectors 31*a* and 31*b* in a pair configured as above forms a refrigerant inlet port of the refrigerant interchanging portion 30 whereas each of the distribution connectors 32*a* and 32*b* in a pair forms a refrigerant outlet port of the refrigerant interchanging portion 30.

The intermediate tank portion 33 is formed of a tube-like member closed at both ends. The intermediate tank portion 33 is disposed between the second windward tank portion 13 and the second leeward tank portion 23. More specifically, when viewed in the flow direction X of blown air, the intermediate tank portion 33 of the present embodiment is disposed in such a manner that a part (upper region) overlaps the second windward tank portion 13 and the second leeward tank portion 23 while another part (lower region) does not overlap the second windward tank portion 13 and the second leeward tank portion 23.

When configured in such a manner as above that the intermediate tank portion 33 is disposed for a part thereof not to overlap the second windward tank portion 13 and the second leeward tank portion 23, the windward evaporation unit 10 and the leeward evaporation unit 20 can be disposed in close proximity to each other in the flow direction X of blown air. Hence, an increase of a physical size of the refrigerant evaporator 1 caused by providing the intermediate tank portion 33 can be restricted.

Figure 3:
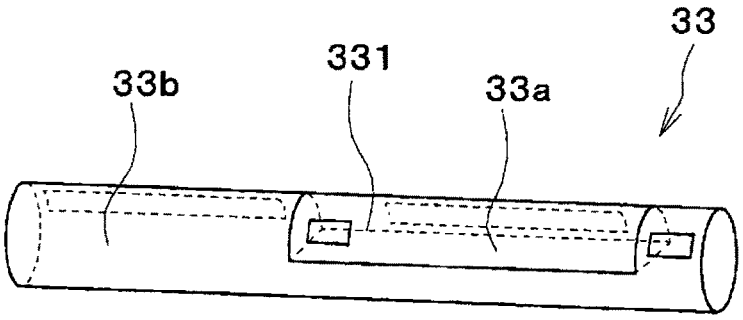
FIG. 3 is a schematic perspective view of an intermediate tank portion of the first embodiment.
Figure 4:
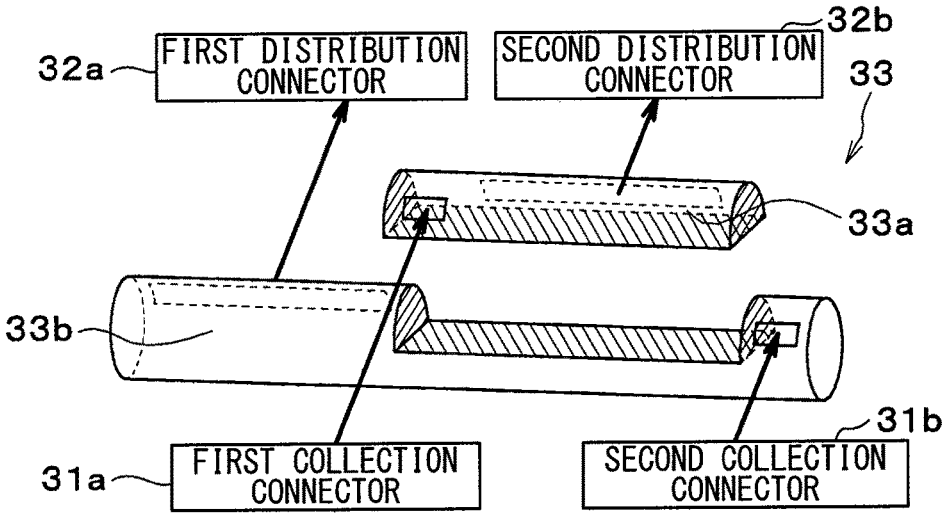
FIG. 4 is an exploded perspective view of the intermediate tank portion shown in FIG. 3.

As shown in FIG. 3 and FIG. 4, a partition member 331 is disposed inside the intermediate tank portion 33 in a region positioned on an upper side. An internal space of the tank is divided by the partition member 331 to the first refrigerant channel 33*a* and the second refrigerant channel 33*b*.

The first refrigerant channel 33*a* forms a refrigerant channel that introduces the refrigerant from the first collection connector 31*a* to the second distribution connector 32*b*. Meanwhile, the second refrigerant channel 33*b* forms a refrigerant channel that introduces the refrigerant from the second collection connector 31*b* to the first distribution connector 32*a*.

In the present embodiment, the first collection connector 31*a*, the second distribution connector 32*b*, and the first refrigerant channel 33*a* in the intermediate tank portion 33 together form a "first communication portion". Also, the second collection connector 31*b*, the first distribution connector 32*a*, and the second refrigerant channel 33*b* in the intermediate tank portion 33 together form a "second communication portion".

Flows of the refrigerant in the refrigerant evaporator 1 of the present embodiment will now be described using FIG. 5.

Figure 5:
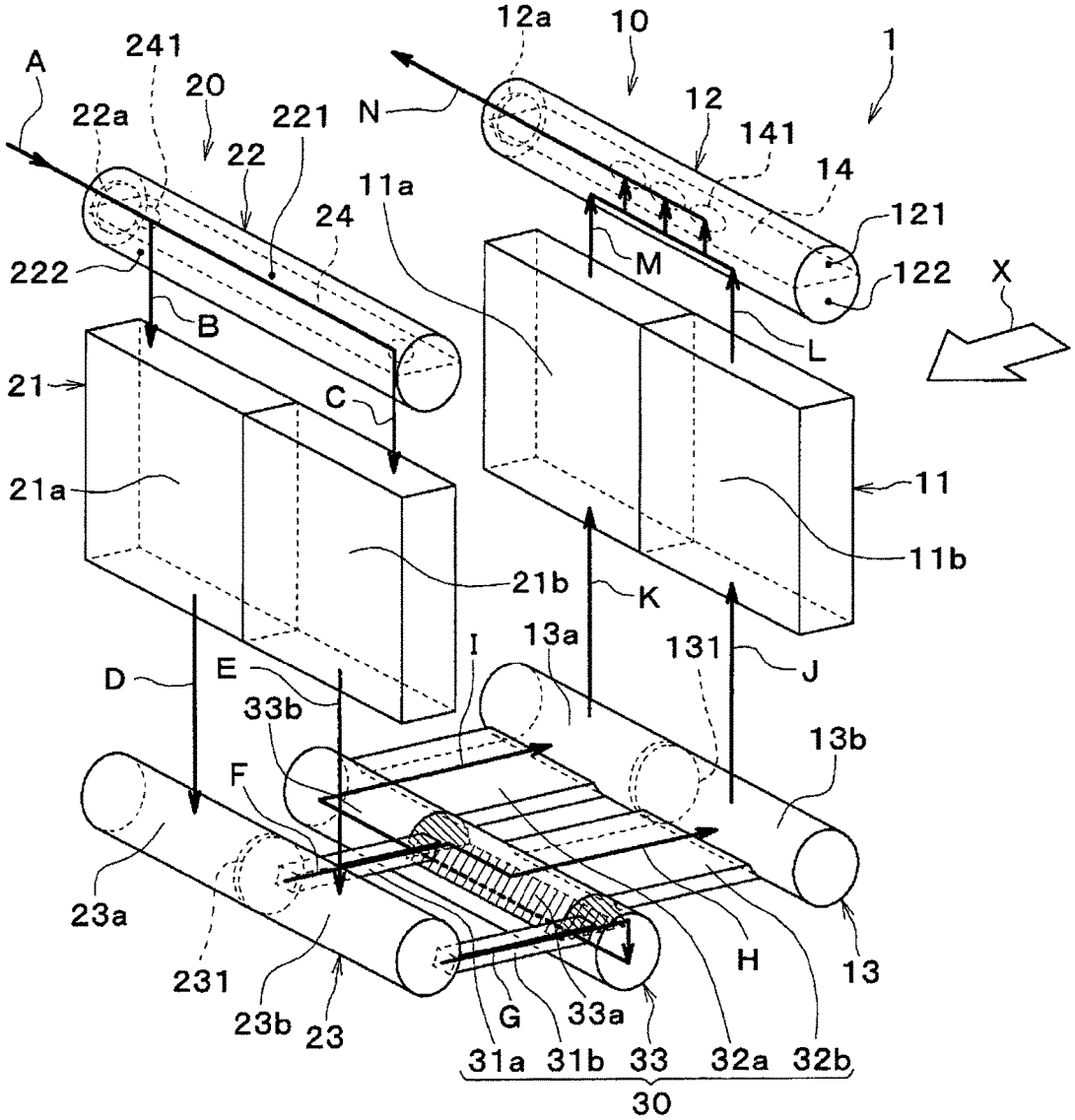
FIG. 5 is a view to describe flows of a refrigerant in the refrigerant evaporator according to the first embodiment.

As shown in FIG. 5, a low-pressure refrigerant decompressed at the expansion valve (not shown) is introduced as indicated by an arrow A from the refrigerant inlet portion 22*a* provided at one end of the first leeward tank portion 22 into the tank and passes through the first communication holes 241 of the first partition member 24. The refrigerant introduced into the first leeward tank portion 22 flows down the first leeward heat-exchanging core portion 21*a* of the leeward heat-exchanging core portion 21 as indicated by an arrow B. Also, the refrigerant that has passed through the first communication hole 241 of the first partition member 24 flows down the second leeward heat-exchanging core portion 21*b* of the leeward heat-exchanging core portion 21 as indicated by an arrow C.

The refrigerant that has flowed down the first leeward heat-exchanging core portion 21*a* flows into the first refrigerant collection portion 23*a* of the second leeward tank portion 23 as indicated by an arrow D. Meanwhile, the refrigerant that has flowed down the second leeward heat-exchanging core portion 21*b* flows into the second refrigerant collection portion 23*b* of the second leeward tank portion 23 as indicated by an arrow E.

The refrigerant that has flowed into the first refrigerant collection portion 23*a* flows into the first refrigerant channel 33*a* in the intermediate tank portion 33 via the first collection connector 31*a* as indicated by an arrow F. Also, the refrigerant that has flowed into the second refrigerant collection portion 23*b* flows into the second refrigerant channel 33*b* in the intermediate tank portion 33 via the second collection connector 31*b* as indicated by an arrow G.

The refrigerant that has flowed into the first refrigerant channel 33*a* flows into the second refrigerant distribution portion 13*b* of the second windward tank portion 13 via the second distribution connector 32*b* as indicated by an arrow H. Also, the refrigerant that has flowed into the second refrigerant channel 33*b* flows into the first refrigerant distribution portion 13*a* of the second windward tank portion 13 via the first distribution connector 32*a* as indicated by an arrow I.

The refrigerant that has flowed into the second refrigerant distribution portion 13*b* of the second windward tank portion 13 flows up the second windward heat-exchanging core portion 11*b* of the windward heat-exchanging core portion 11 as indicated by an arrow J. Meanwhile, the refrigerant that has flowed into the first refrigerant distribution portion 13*a* flows up the first windward heat-exchanging core portion 11*a* of the windward heat-exchanging core portion 11 as indicated by an arrow K.

The refrigerant that has flowed up the second windward heat-exchanging core portion 11*b* and the refrigerant that has flowed up the first windward heat-exchanging core portion 11*a* flow into the tank of the first windward tank portion 12 as indicated by arrows L and M, respectively. Subsequently, the refrigerants are introduced to a drawing side of the compressor (not shown) from the refrigerant outlet portion 12*a* provided at one end of the first windward tank portion 12 by passing through the second communication holes 141 of the second partition member 14 as indicated by an arrow N.

In the refrigerant evaporator 1 of the present embodiment as described above, the first communication holes 241 are provided to the first partition member 24 and the second communication holes 141 are provided to the second partition member 14, and the first communication holes 241 and the second communication holes 141 are disposed asymmetrically with respect to the virtual line LL passing a center between the first leeward tank portion 22 and the first windward tank portion 12 and orthogonal to the flow direction X of blown air.

By providing the second communication holes 141 to the second partition member 14, a pressure loss is reduced in tubes disposed in the vicinity of the second communication holes 141 (hereinafter, referred to as the windward center tubes 111) among the multiple tubes 111 of the windward heat-exchanging core portion 11, and in tubes disposed at a position so as to overlap the windward center tubes 111 when viewed in the flow direction X of blown air (hereinafter, referred to as the leeward center tubes 211) among the multiple tubes 211 of the leeward heat-exchanging core portion 21.

Herein, because a pressure loss is reduced in the leeward center tubes 211 of the leeward heat-exchanging core portion 21, a back pressure differs among the respective tubes 211. Hence, a liquid phase refrigerant readily flows the leeward heat-exchanging core portion 21 in a center portion in the tube stacking direction and hardly flows at both ends in the tube stacking direction.

It should be noted, however, that the first communication hole 241 is provided to the first partition member 24 in the present embodiment, and the first communication holes 241 and the second communication hole 141 are disposed asymmetrically with respect to the virtual line LL passing a center between the first leeward tank portion 22 and the first windward tank portion 12 and orthogonal to the flow direction X of blown air. More specifically, the first communication holes 241 are disposed at positions so as not to overlap the second communication holes 141 when viewed in the flow direction X of blown air.

Hence, a pressure loss is reduced in tubes disposed in the vicinity of the first communication holes 241 (hereinafter, referred to as the leeward end tubes 211) among the multiple tubes 211 of the leeward heat-exchanging core portion 21, and in tubes disposed at a position so as to overlap the leeward end tubes 211 when viewed in the blown air direction X (hereinafter, referred to as the windward end tubes 111) among the multiple tubes 111 of the windward heat-exchanging core portion 11.

Accordingly, when the refrigerant evaporator 1 is viewed in the flow direction X of blown air, a pressure loss can be made uniform in the tubes 111 and 211 of the entire overlapping region in the leeward heat-exchanging core portion 21 and the windward heat-exchanging core portion 11. Hence, distribution of the liquid phase refrigerant in the heat-exchanging core portions 11 and 21 can be enhanced. Consequently, an inconvenience that a temperature distribution is generated in the blown air passing through the refrigerant evaporator 1 can be restricted.

Figure 6:
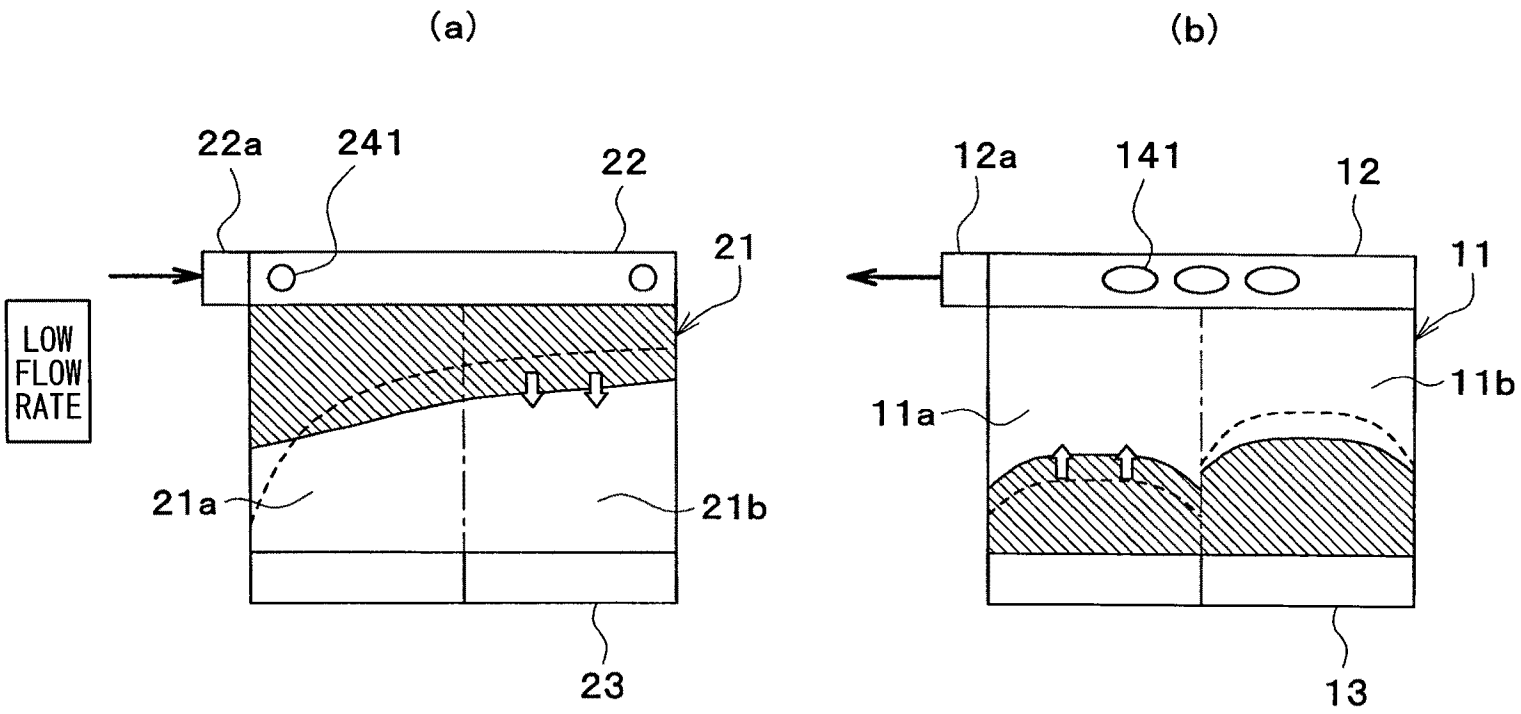
FIG. 6 is a view to describe a distribution of a liquid phase refrigerant flowing respective heat-exchanging core portions when a flow rate of the refrigerant circulating in a refrigeration cycle is low in the refrigerant evaporator according to the first embodiment.
Figure 7:
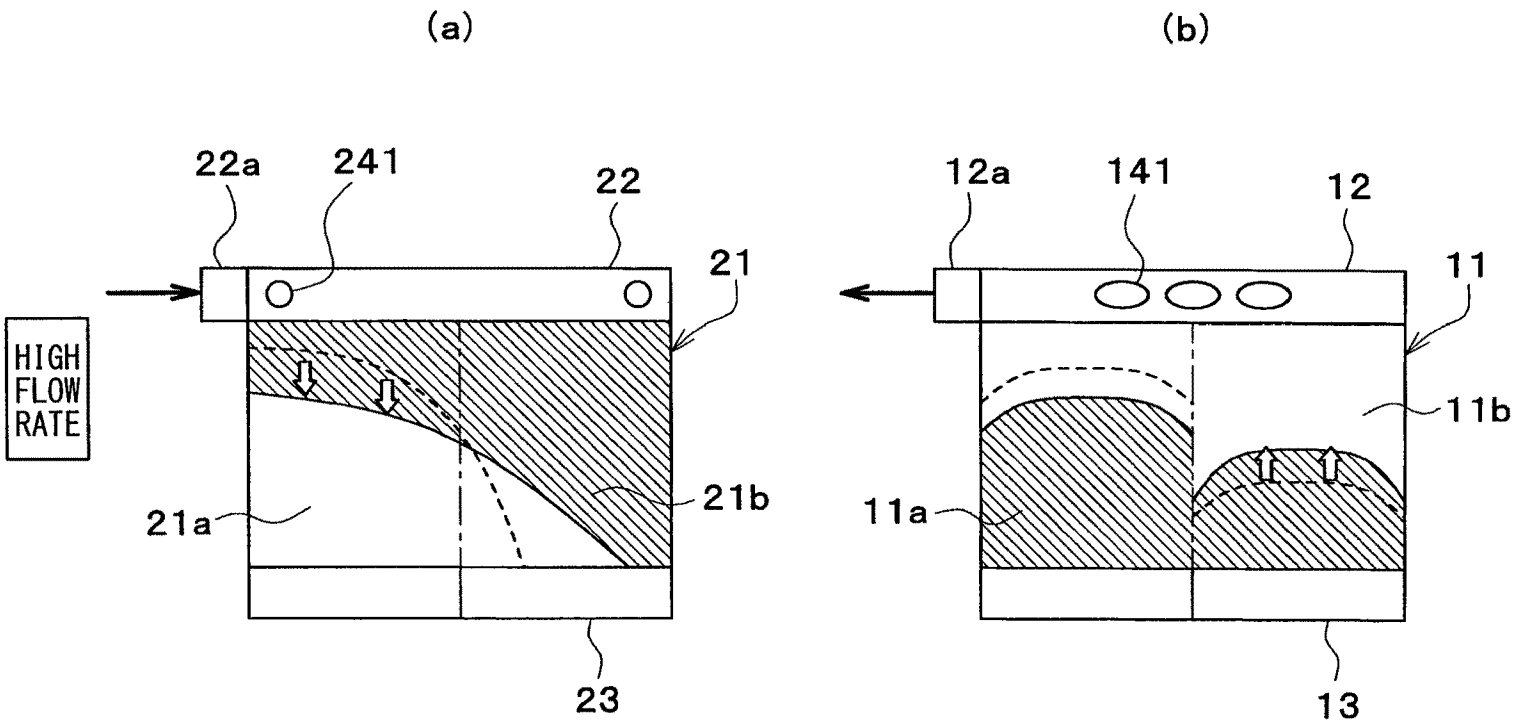
FIG. 7 is a view to describe a distribution of a liquid phase refrigerant flowing the respective heat-exchanging core portions when a flow rate of the refrigerant circulating in the refrigeration cycle is high in the refrigerant evaporator according to the first embodiment.

FIG. 6 and FIG. 7 are views to describe a distribution of the liquid phase refrigerant flowing the respective heat-exchanging core portions 11 and 21 of the refrigerant evaporator 1 of the present embodiment. FIG. 6 shows a case where a flow rate of the refrigerant circulating in the refrigeration cycle is low and FIG. 7 shows a case where a flow rate of the refrigerant circulating in the refrigeration cycle is high.

FIG. 6 (*a*) and FIG. 7 (*a*) show a distribution of the liquid phase refrigerant flowing the leeward heat-exchanging core portion 21. FIG. 6 (*b*) and FIG. 7 (*b*) show a distribution of the liquid phase refrigerant flowing the windward heat-exchanging core portion 11.

FIG. 6 and FIG. 7 show distributions of the liquid phase refrigerant when the refrigerant evaporator 1 is viewed in a direction indicated by an arrow Y of FIG. 1 (a direction opposite to the flow direction X of blown air), and shaded portions in the respective drawings represent a portion where the liquid phase refrigerant is present. A broken line in FIG. 6 and FIG. 7 indicates a tip end position of a distribution of a liquid phase refrigerant in a refrigerant evaporator of a comparative example (a refrigerant evaporator in which a first partition member 24 and first communication hole 241 are not provided inside a first leeward tank portion 22).

When a flow rate of the refrigerant flowing the refrigerant cycle is low, in the refrigerant evaporator of the comparative example, the liquid phase refrigerant that has flowed into the first leeward tank portion 22 from a refrigerant inlet portion 22*a* is susceptible to a gravitational force. Hence, as is indicated by a broken line of FIG. 6 (*a*), the refrigerant readily flows into tubes 211 near the refrigerant inlet portion 22*a* and hardly flows away from the refrigerant inlet portion 22*a*. On the contrary, in the refrigerant evaporator 1 of the present embodiment, as is indicated by a shaded portion of FIG. 6 (*a*), the refrigerant readily flows away from the refrigerant inlet portion 22*a*.

In the refrigerant evaporator of the comparative example, the refrigerant readily flows into the tubes 211 near the refrigerant inlet portion 22*a* in a leeward heat-exchanging core portion 21. Accordingly, as is indicated by a broken line of FIG. 6 (*b*), a flow rate of the liquid phase refrigerant flowing a windward heat-exchanging core portion 11 is lower in a first windward heat-exchanging core portion 11*a* than in a second windward heat-exchanging core portion 11*b*. On the contrary, in the refrigerant evaporator 1 of the present embodiment, as is indicated by a shaded portion of FIG. 6 (*b*), a flow rate of the liquid phase refrigerant is relatively equal in the first windward heat-exchanging core portion 11*a* and the second windward heat-exchanging core portion 11*b*.

When a flow rate of the refrigerant flowing the refrigeration cycle is high, in the refrigerant evaporator of the comparative example, the liquid phase refrigerant that has flowed into the first leeward tank portion 22 from the refrigerant inlet portion 22*a* readily flows away from the refrigerant inlet portion 22*a* due to an inertial force. Accordingly, as is indicated by a broken line of FIG. 7 (*a*), the refrigerant hardly flows near the refrigerant inlet portion 22*a* and readily flows into the tubes 211 away from the refrigerant inlet portion 22*a*.

On the contrary, in the refrigerant evaporator 1 of the present embodiment, as is indicated by a shaded portion of FIG. 7 (*a*), the refrigerant readily flows near the refrigerant inlet portion 22*a*.

In the refrigerant evaporator of the comparative example, the refrigerant readily flows into the tubes 211 away from the refrigerant inlet portion 22*a* in the leeward heat-exchanging core portion 21. Accordingly, as is indicated by a broken line of FIG. 7 (*b*), a flow rate of the liquid phase refrigerant flowing the windward heat-exchanging core portion 11 is higher in the first windward heat-exchanging core portion 11*a* than in the second windward heat-exchanging core portion 11*b*.

On the contrary, in the refrigerant evaporator 1 of the present embodiment, as is indicated by a shaded portion of FIG. 7 (*b*), a flow rate of the liquid phase refrigerant is relatively equal in the first windward heat-exchanging core portion 11*a* and the second windward heat-exchanging core portion 11*b*.

The refrigerant expands and increases in volume as headed downstream in a flow of the refrigerant. Hence, by making a total area of the multiple second communication holes 141 provided to the second partition member 14 larger than a total area of the multiple first communication holes 241 provided to the first partition member 24 as in the present embodiment, the refrigerant readily flows into the second communication holes 141 even when the refrigerant expands.

Second Embodiment

A second embodiment will be described with reference to FIG. 8. The second embodiment is different from the first embodiment above in a configuration of first communication holes 241 and second communication holes 141.

Figure 8:
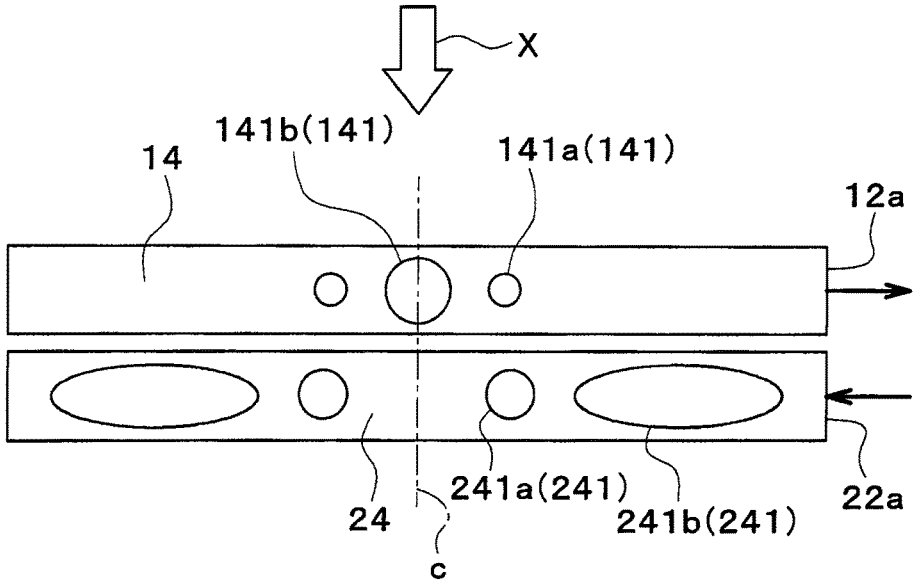
FIG. 8 is a view to describe a first partition member and a second partition member of a refrigerant evaporator according to a second embodiment.

As shown in FIG. 8, first communication holes 241*a*, which are a part of multiple first communication holes 241, are disposed at positions so as to overlap the second communication holes 141 when viewed in a flow direction X of blown air. First communication holes 241*b*, which are the rest of the multiple first communication holes 241, are disposed at positions so as not to overlap the second communication holes 141 when viewed in the flow direction X of blown air.

Second communication holes 141*a*, which are a part of the multiple second communication holes 141, are disposed at positions so as to overlap the first communication holes 241 when viewed in the flow direction X of blown air. A second communication hole 141*b*, which is a remaining of the multiple second communication holes 141, is disposed at a position so as not to overlap the first communication holes 241 when viewed in the flow direction X of blown air.

In the present embodiment, both of the first communication holes 241 and the second communication holes 141 are disposed symmetrically with respect to a center line c of a first partition member 24 and a second partition member 14 in a tube stacking direction.

More specifically, the first communication holes 241*b* in the rest part are disposed at both ends of the first partition member 24 in the tube stacking direction, that is, one at each end. The first communication holes 241*a* in a part are disposed adjacently to the first communication holes 241*b* in the rest part in a one-to-one correspondence.

The remaining second communication hole 141*b* is a single hole disposed at a center of the second partition member 14 in the tube stacking direction. The second communication holes 141*a* in a part are disposed on both sides of the remaining second communication hole 141*b*, that is, one on each side.

In the present embodiment, the first communication holes 241*b*, which are the rest of the multiple first communication holes 241, are disposed at positions so as not to overlap the second communication holes 141 when viewed in the flow direction X of blown air. Hence, advantageous effects same as the advantageous effects of the first embodiment above can be obtained.

Third Embodiment

A third embodiment will now be described using FIG. 12 through FIG. 18.

Figure 13:
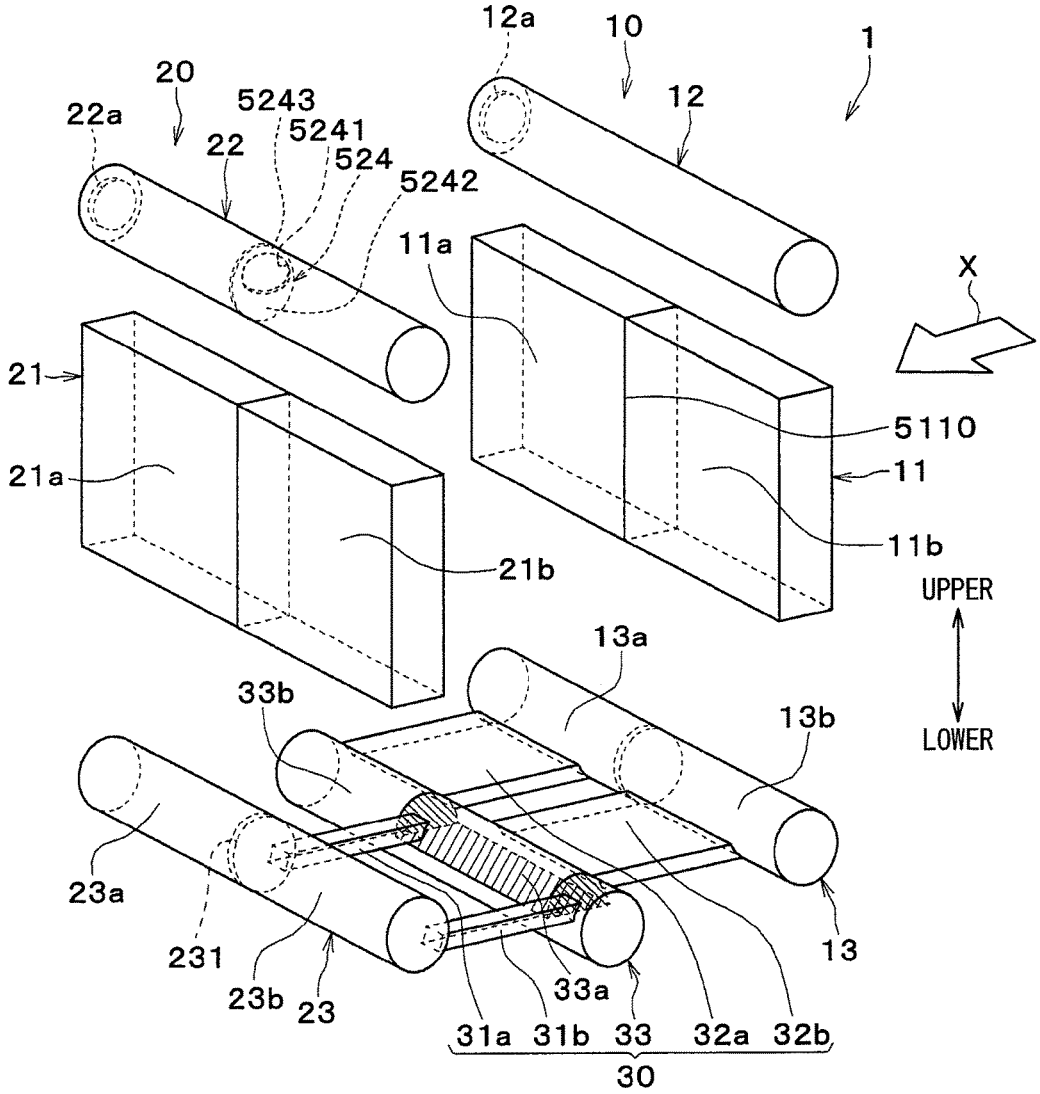
FIG. 13 is an exploded perspective view of the refrigerant evaporator shown in FIG. 12.

In FIG. 13, tubes 111, 211 and fins 112, 212 of respective heat-exchanging core portions 11, 21 described below are omitted.

Figure 14:
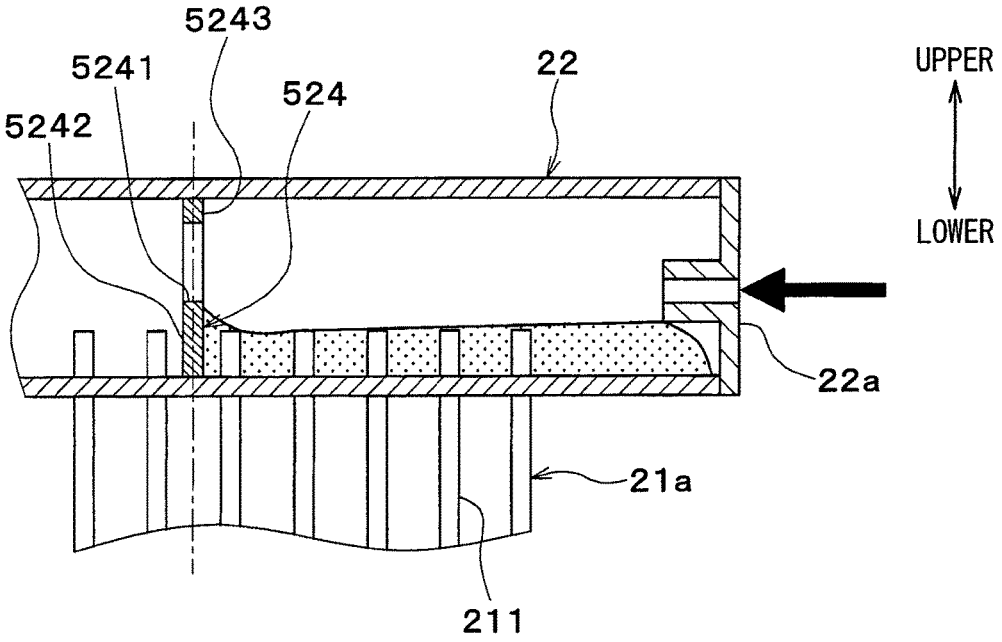
FIG. 14 is an enlarged sectional view showing a vicinity of a first leeward tank portion of the third embodiment.

As shown in FIG. 14, a dam plate 524 is provided inside a first leeward tank portion 22. The dam plate 524 serves as a dam portion that holds back a flow of a liquid phase refrigerant that has flowed into the first leeward tank portion 22 from a refrigerant inlet portion 22*a*.

Figure 15:
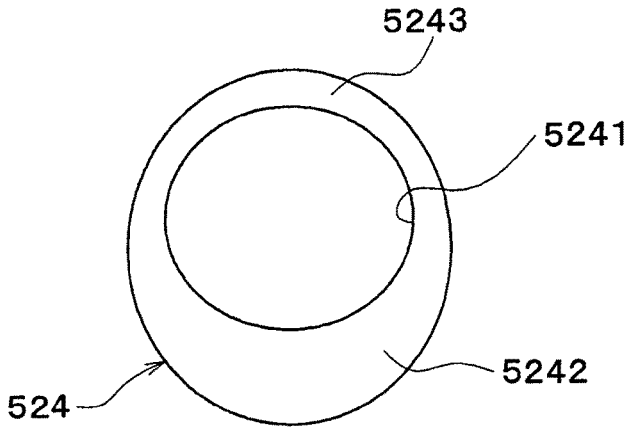
FIG. 15 is a front view of a dam plate of the third embodiment.

As shown in FIG. 15, the dam plate 524 is formed in substantially a disc shape and an outer peripheral surface is bonded to an inner peripheral surface of the first leeward tank portion 22. The dam plate 524 has a through-hole 5241 penetrating from one side to the other side. The through-hole 5241 is disposed on a slightly upper side of a center portion of the dam plate 524 in a vertical direction (opposite side to the leeward heat-exchanging core portion 21 in a tube longitudinal direction).

Owing to the configuration as above, a flow of the liquid phase refrigerant can be held back by a region (hereinafter, referred to as a dam portion 5242) of the dam plate 524 in a lower side in the vertical direction (on a side near the leeward heat-exchanging core portion 21 in the tube longitudinal direction) where the through-hole 5241 is not provided. In the present embodiment, the dam portion 5242 extends upward from a lower end of the first leeward tank portion 22. An upper end of the dam portion 5242 is positioned above ends of the tubes 211 in the longitudinal direction.

In addition, the liquid phase refrigerant that has scattered when flowing inside from the refrigerant inlet portion 22*a* can be dropped by a region (hereinafter, referred to as a protrusion portion 5243) of the dam plate 524 on an upper side in the vertical direction (on an opposite side to the leeward heat-exchanging core portion 21 in the tube longitudinal direction) where the through-hole 5241 is not provided. In the present embodiment, the protrusion portion 5243 extends downward from an upper part of the first leeward tank portion 22.

As shown in FIG. 13, when a refrigerant evaporator 1 is viewed in a flow direction X of blown air, the dam plate 524 is disposed at a position (see an alternate long and short dash line of FIG. 14) so as to overlap a boundary 5110 between a first windward heat-exchanging core portion 11*a* and a second windward heat-exchanging core portion 11*b* of a windward evaporation unit 10.

In the present embodiment, the boundary 5110 between the first windward heat-exchanging core portion 11*a* and the second windward heat-exchanging core portion 11*b* of the windward evaporation unit 10 is positioned in a center portion of the windward evaporation unit 10 in the tube stacking direction. Hence, the dam plate 524 is disposed in a center portion of the first leeward tank portion 22 in the tube stacking direction.

In the present embodiment, the dam plate 524 (more specifically, the dam portion 5242) forms a "dam portion", and the protrusion portion 5243 forms a "protrusion portion".

Flows of the refrigerant in the refrigerant evaporator 1 of the present embodiment will now be described using FIG. 16.

Figure 16:
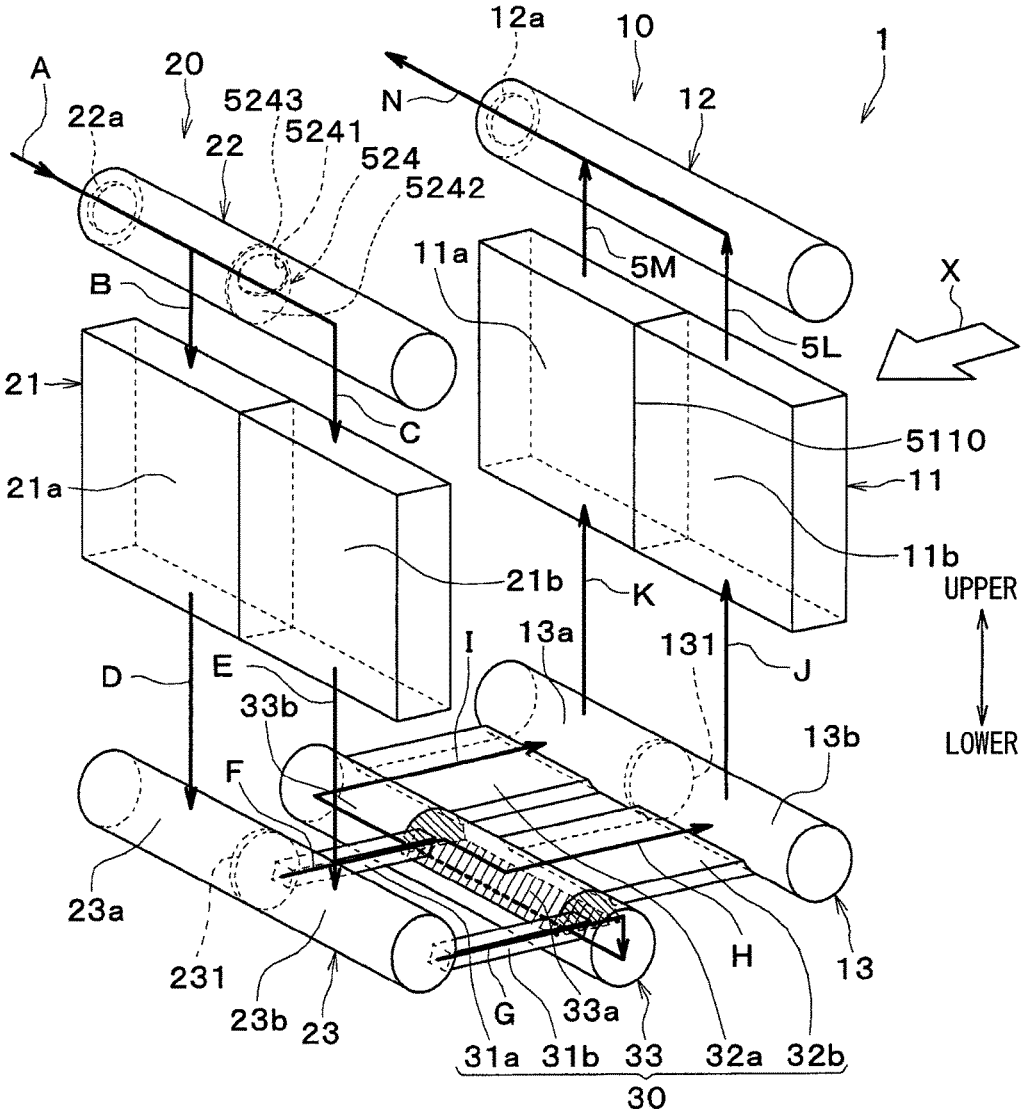
FIG. 16 is a view to describe flows of a refrigerant in the refrigerant evaporator according to the third embodiment.

As shown in FIG. 16, a low-pressure refrigerant decompressed at an expansion valve (not shown) is introduced as indicated by an arrow A from the refrigerant inlet portion 22*a* provided at one end of the first leeward tank portion 22 into the tank. The refrigerant introduced into the first leeward tank portion 22 flows down a first leeward heat-exchanging core portion 21*a* of the leeward heat-exchanging core portion 21 as indicated by an arrow B. Also, the refrigerant that has passed through the through-hole 5241 of the dam plate 524 flows down a second leeward heat-exchanging core portion 21*b* of the leeward heat-exchanging core portion 21 as indicated by an arrow C.

The refrigerant that has flowed down the first leeward heat-exchanging core portion 21*a* flows into a first refrigerant collection portion 23*a* of a second leeward tank portion 23 as indicated by an arrow D. Meanwhile, the refrigerant that has flowed down the second leeward heat-exchanging core portion 21*b* flows into a second refrigerant collection portion 23*b* of the second leeward tank portion 23 as indicated by an arrow E.

The refrigerant that has flowed into the first refrigerant collection portion 23*a* flows into a first refrigerant channel 33*a* in an intermediate tank portion 33 via a first collection connector 31*a* as indicated by an arrow F. Also, the refrigerant that has flowed into the second refrigerant collection portion 23*b* flows into a second refrigerant channel 33*b* in the intermediate tank portion 33 via a second collection connector 31*b* as indicated by an arrow G.

The refrigerant that has flowed into the first refrigerant channel 33*a* flows into a second refrigerant distribution portion 13*b* of a second windward tank portion 13 via a second distribution connector 32*b* as indicated by an arrow H. Also, the refrigerant that has flowed into the second refrigerant channel 33*b* flows into a first refrigerant distribution portion 13*a* of the second windward tank portion 13 via a first distribution connector 32*a* as indicated by an arrow I.

The refrigerant that has flowed into the second refrigerant distribution portion 13*b* of the second windward tank portion 13 flows up the second windward heat-exchanging core portion 11*b* of the windward heat-exchanging core portion 11 as indicated by an arrow J. Meanwhile, the refrigerant that has flowed into the first refrigerant distribution portion 13*a* flows up the first windward heat-exchanging core portion 11*a* of the windward heat-exchanging core portion 11 as indicated by an arrow K.

The refrigerant that has flowed up the second windward heat-exchanging core portion 11*b* and the refrigerant that has flowed up the first windward heat-exchanging core portion 11*a* flow into the tank of a first windward tank portion 12 as indicated by arrows 5L and 5M, respectively. Subsequently, the refrigerants are introduced to a drawing side of a compressor (not shown) from a refrigerant outlet portion 12*a* provided at one end of the first windward tank portion 12 as indicated by an arrow N.

In the refrigerant evaporator 1 of the present embodiment described as above, the dam plate 524 is provided inside the first leeward tank portion 22 so as to hold back a flow of a liquid phase refrigerant that has flowed into the first leeward tank portion 22 from the refrigerant inlet portion 22*a*. Hence, even when a flow rate of the refrigerant flowing a refrigeration cycle is low, the liquid phase refrigerant can be let into the tubes 211 disposed between the refrigerant inlet portion 22*a* and the dam plate 524 (in the present embodiment, the tubes 211 making up the first leeward heat-exchanging core portion 21*a*) in a reliable manner.

Also, by disposing the dam plate 524 at the position so as to overlap the boundary 5110 between the first windward heat-exchanging core portion 11*a* and the second windward heat-exchanging core portion 11*b* when viewed in the flow direction X of blown air, the liquid phase refrigerant can be passed to the second windward heat-exchanging core portion 11*b* that does not oppose the first leeward heat-exchanging core portion 21*a*.

Hence, when the refrigerant evaporator 1 is viewed in the flow direction X of blown air, the liquid phase refrigerant can be passed across an entire overlapping region in the windward heat-exchanging core portion 11 and the leeward heat-exchanging core portion 21. Consequently, an inconvenience that a temperature distribution is generated in the blown air passing through the refrigerant evaporator 1 when a flow rate of the refrigerant flowing the refrigeration cycle is low can be restricted.

Figure 17:
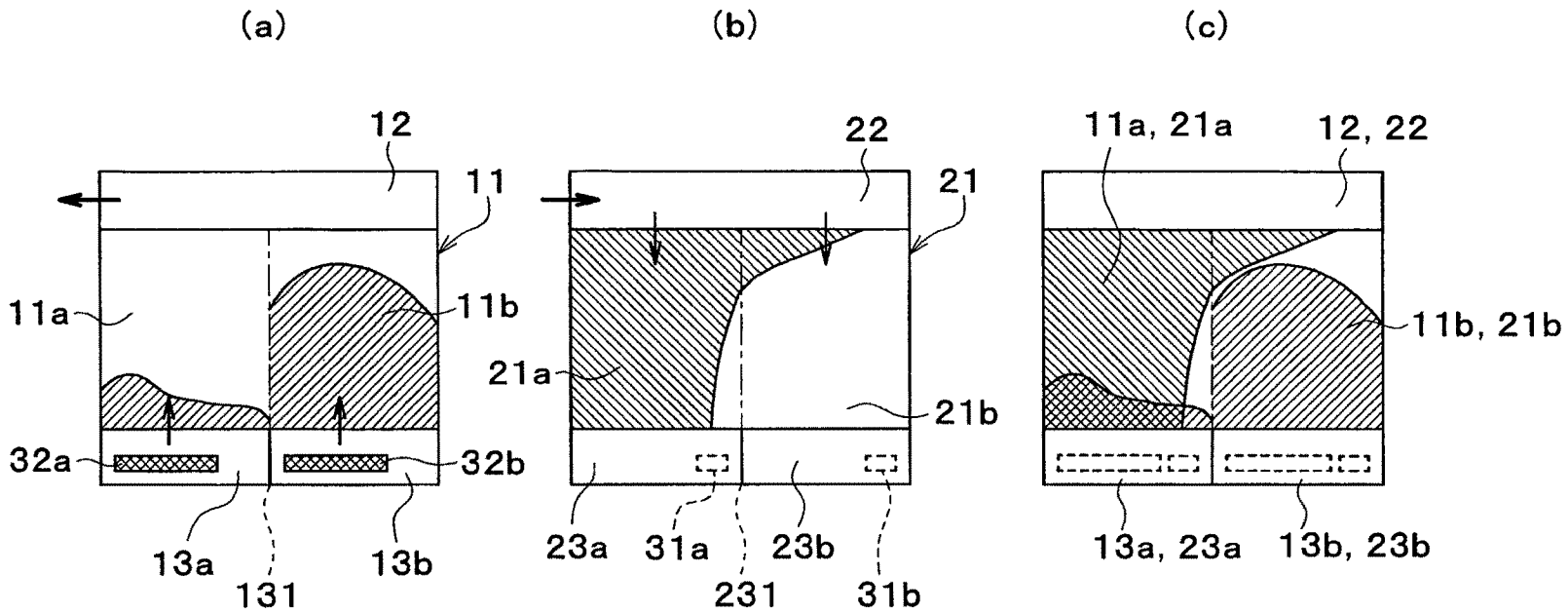
FIG. 17 is a view to describe a distribution of a liquid phase refrigerant flowing respective heat-exchanging core portions of a refrigerant evaporator according to a comparative example.
Figure 18:
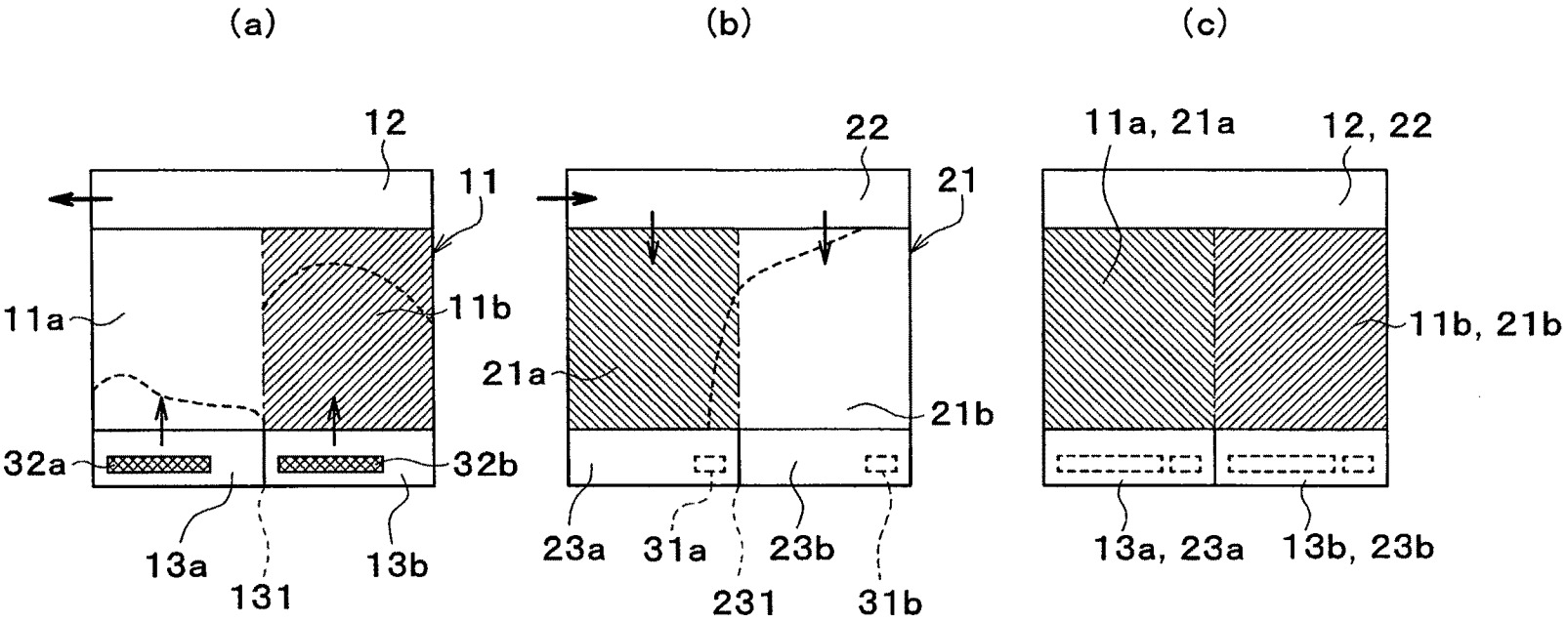
FIG. 18 is a view to describe a distribution of a liquid phase refrigerant flowing respective heat-exchanging core portions of the refrigerant evaporator according to the third embodiment.

FIG. 17 is a view to describe a distribution of a liquid phase refrigerant flowing respective heat-exchanging core portions 11 and 21 of a refrigerant evaporator according to a comparative example (a refrigerant evaporator in which a dam plate 524 is not provided inside a first leeward tank portion 22). FIG. 18 is a view to describe a distribution of a liquid phase refrigerant flowing the respective heat-exchanging core portions 11 and 21 of the refrigerant evaporator 1 according to the present embodiment.

FIG. 17 (*a*) and FIG. 18 (*a*) show a distribution of the liquid phase refrigerant flowing the windward heat-exchanging core portion 11. FIG. 17 (*b*) and FIG. 18 (*b*) show a distribution of the liquid phase refrigerant flowing the leeward heat-exchanging core portion 21. FIG. 17 (*c*) and FIG.

18 (*c*) show a synthesis of distributions of the liquid phase refrigerant flowing the respective heat-exchanging core portions 11 and 21.

Figure 12:
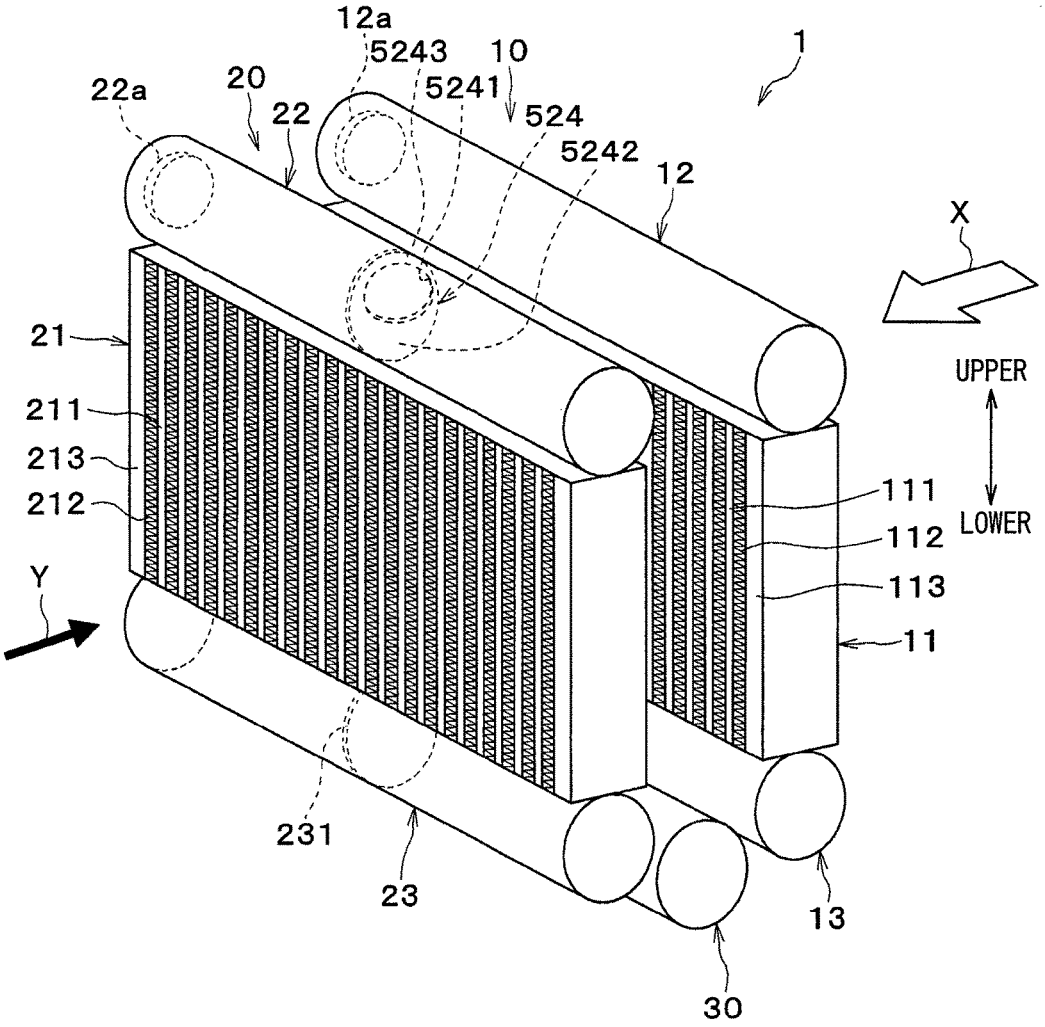
FIG. 12 is a schematic perspective view of a refrigerant evaporator according to a third embodiment.

FIG. 17 and FIG. 18 show distributions of the liquid phase refrigerant when the refrigerant evaporator 1 is viewed in a direction indicted by an arrow Y of FIG. 12 (a direction opposite to the flow direction X of blown air), and shaded portions in the respective drawings represent a portion where the liquid phase refrigerant is present. A broken line in FIG. 18 indicates a distribution of the liquid phase refrigerant in the refrigerant evaporator of the comparative example for ease of description.

Firstly, a distribution of the liquid phase refrigerant flowing the leeward heat-exchanging core portion 21 in the refrigerant evaporator of the comparative example will be described. As shown in FIG. 17 (*b*), a portion where the liquid phase refrigerant hardly flows (a hollow portion in the drawing) is developed in a part of a first leeward heat-exchanging core portion 21*a* and in most of a second leeward heat-exchanging core portion 21*b*.

Hence, regarding a distribution of the liquid phase refrigerant flowing the windward heat-exchanging core portion 11 in the refrigerant evaporator of the comparative example, as shown in FIG. 17 (*a*), a flow rate of the liquid phase refrigerant flowing the windward heat-exchanging core portion 11 is lower in a first windward heat-exchanging core portion 11*a* than in a second windward heat-exchanging core portion 11*b*, and a portion where the liquid phase refrigerant hardly flows (a hollow portion in the drawing) is developed in both of the first windward heat-exchanging core portion 11*a* and the second windward heat-exchanging core portion 11*b*.

When the refrigerant evaporator of the comparative example is viewed in the flow direction X of blown air, as shown in FIG. 17 (*c*), a portion where the liquid phase refrigerant hardly flows (a hollow portion in the drawing) is developed in a part of the overlapping region in the windward heat-exchanging core portion 11 and the leeward heat-exchanging core portion 21.

In contrast, according to the refrigerant evaporator 1 of the present embodiment, the dam plate 524 is provided inside the first leeward tank portion 22. Accordingly, the liquid phase refrigerant held back by the dam plate 524 flows into the first leeward heat-exchanging core portion 21*a*. Hence, regarding a distribution of the liquid phase refrigerant flowing the leeward heat-exchanging core portion 21, as shown in FIG. 18 (*b*), the liquid phase refrigerant flows substantially across the entire first leeward heat-exchanging core portion 21*a*. On the other hand, the liquid phase refrigerant hardly flows into the second leeward heat-exchanging core portion 21*b*. Hence, a portion where the liquid phase refrigerant hardly flows (a hollow portion in the drawing) is developed substantially across the entire second leeward heat-exchanging core portion 21*b*.

Consequently, regarding a distribution of the liquid phase refrigerant flowing the windward heat-exchanging core portion 11 in the refrigerant evaporator 1 of the present embodiment, as is shown in FIG. 18 (*a*), a flow rate of the liquid phase refrigerant flowing into the second windward heat-exchanging core portion 11*b* of the windward heat-exchanging core portion 11 increases and the liquid phase refrigerant flows substantially across the entire second windward heat-exchanging core portion 11*b*. On the other hand, a flow rate of the liquid phase refrigerant flowing into the first windward heat-exchanging core portion 11*a* decreases. Hence, a portion where the liquid phase refrigerant hardly flows (a hollow portion in the drawing) is developed substantially across the entire first windward heat-exchanging core portion 11*a*.

Accordingly, when the refrigerant evaporator 1 of the present embodiment is viewed in the flow direction X of blown air, as is shown in FIG. 18 (*c*), the liquid phase refrigerant flows the entire overlapping region in the windward heat-exchanging core portion 11 and the leeward heat-exchanging core portion 21.

Fourth Embodiment

Figure 19:
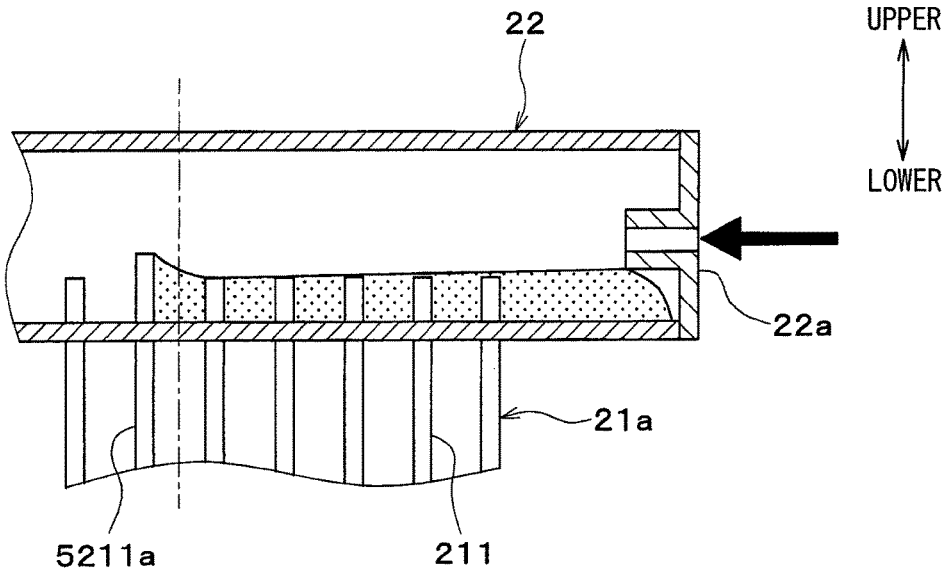
FIG. 19 is an enlarged sectional view showing a vicinity of a first leeward tank portion of a fourth embodiment.

A fourth embodiment will be described according to FIG. 19. The fourth embodiment is different from the third embodiment above in a configuration of a dam portion.

Herein, among multiple tubes 211 of a leeward evaporation unit 20, a tube 211 disposed at a position nearest to a region (see an alternate long and short dash line in the drawing) overlapping a boundary 5110 between a first windward heat-exchanging core portion 11*a* and a second windward heat-exchanging core portion 11*b* of a windward evaporation unit 10 when viewed in a flow direction X of blown air is referred to as a boundary tube 5211*a*.

A longitudinal end of the boundary tube 5211*a* protrudes inside a first leeward tank portion 22 more than end portions of the multiple tubes 211 of the leeward evaporation unit 20 other than the boundary tube 5211*a* away from a leeward heat-exchanging core portion 21 in the longitudinal direction. More specifically, an upper end of the boundary tube 5211*a* protrudes to an upper side more than upper ends of the multiple tubes 211 of the leeward evaporation unit 20 other than the boundary tube 5211*a*.

A flow of the liquid phase refrigerant (a dot-shaded portion in the drawing) that has flowed into the first leeward tank portion 22 from a refrigerant inlet portion 22*a* is held back by a region of the boundary tube 5211*a* disposed inside the first leeward tank portion 22. Hence, even when a flow rate of the refrigerant flowing a refrigeration cycle is low, the liquid phase refrigerant can be let into the tubes 211 disposed between the refrigerant inlet portion 22*a* and the boundary tube 5211*a* (in the present embodiment, the tubes 211 making up a first leeward heat-exchanging core portion 21*a*) in a reliable manner. Hence, advantageous effects same as the advantageous effects of the third embodiment above can be obtained.

The boundary tube 5211*a* of the present embodiment forms a "dam portion".

Fifth Embodiment

Figure 20:
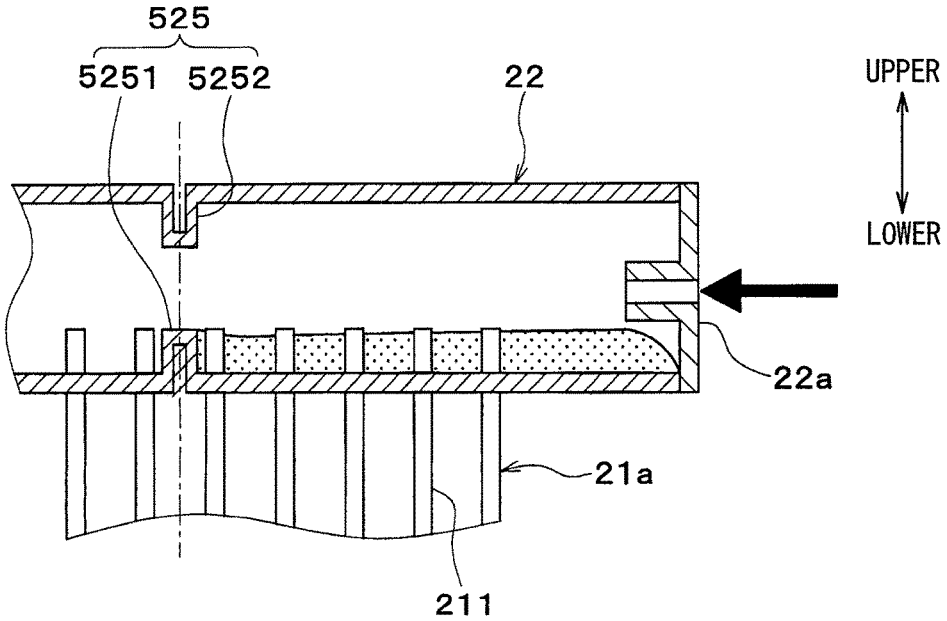
FIG. 20 is an enlarged sectional view showing a vicinity of a first leeward tank portion of a fifth embodiment.

A fifth embodiment will be described according to FIG. 20. The fifth embodiment is different from the third embodiment above in a configuration of a dam portion.

When viewed in a flow direction X of blown air, a first leeward tank portion 22 has a convex portion 525 protruding inward of the first leeward tank portion 22 along an entire periphery of a region (see an alternate and short dash line in the drawing) overlapping a boundary 5110 between a first windward heat-exchanging core portion 11*a* and a second windward heat-exchanging core portion 11*b* of a windward evaporation unit 10. The convex portion 525 is provided by deforming the first leeward tank portion 22 itself so as to protrude inward of the tank.

A flow of a liquid phase refrigerant that has flowed inside from a refrigerant inlet portion 22*a* can be held back by an upper side of the convex portion 525, that is, a region positioned on a side near a leeward core portion 21 in a tube longitudinal direction (hereinafter, referred to as a first convex portion 5251). In addition, a liquid phase refrigerant scattered when flowing inside from the refrigerant inlet portion 22*a* can be dropped by a lower side of the convex portion 525, that is, a region positioned on the opposite side to the leeward core portion 21 in the tube longitudinal direction (hereinafter, referred to as a second convex portion 5252).

According to the present embodiment, even when a flow rate of the refrigerant flowing a refrigeration cycle is low, a liquid phase refrigerant can be let into tubes 211 disposed between the refrigerant inlet portion 22*a* and the convex portion 525 (in the present embodiment, the tubes 211 making up a first leeward heat-exchanging core portion 21*a*) in a reliable manner. Hence, advantageous effects same as the advantageous effects of the third embodiment above can be obtained.

In the present embodiment, the first convex portion 5251 forms a "dam portion" and the second convex portion 5252 forms a "protrusion portion".

Other Embodiments

The present disclosure is not limited to the embodiments described above, and can be modified in various manners within the scope of the present disclosure as follows.

The embodiments above have described a case where the refrigerant interchanging portion 30 includes a pair of the collection connectors 31*a* and 31*b*, a pair of the distribution connectors 32*a* and 32*b*, and the intermediate tank portion 33 by way of example. However, the refrigerant interchanging portion 30 is not limited to the example above. For example, the refrigerant interchanging portion 30 may be configured so as to directly connect the connectors 31*a* and 32*b* and also directly connect the connectors 31*b* and 32*a* by omitting the intermediate tank portion 33.

When the refrigerant evaporator 1 is viewed in the flow direction X of blown air, the first windward heat-exchanging core portion 11*a* and the first leeward heat-exchanging core portion 21*a* are disposed to fully overlap, and the second windward heat-exchanging core portion 11*b* and the second leeward heat-exchanging core portion 21*b* are disposed to fully overlap in the above embodiment. However, the present disclosure is not limited to the above case. It may be configured in such a manner that when the refrigerant evaporator 1 is viewed in the flow direction X of blown air, the first windward heat-exchanging core portion 11*a* and the first leeward heat-exchanging core portion 21*a* are disposed to partially overlap, and the second windward heat-exchanging core portion 11*b* and the second leeward heat-exchanging core portion 21*b* are disposed to partially overlap.

It is preferable to dispose the windward evaporation unit 10 upstream of the leeward evaporation unit 20 in the flow direction X of blown air in the refrigerant evaporator 1. However, the present disclosure is not limited to the above configuration and the windward evaporation unit 10 may be disposed downstream of the leeward evaporation unit 20 in the flow direction X of blown air.

The heat-exchanging core portion 11, 21 is defined by the multiple tubes 111, 211 and the fins 112, 212 in the above embodiment. However, the present disclosure is not limited to the above case and the heat-exchanging core portion 11, 21 may be made up of only the multiple tubes 111, 211. In a case where the heat-exchanging core portion 11, 21 is made up of the multiple tubes 111, 211 and the fins 112, 212, the fins 112, 212 are not limited to corrugate fins and plate fins may be adopted instead.

The refrigerant evaporator 1 is applied to the refrigerating cycle in the air conditioner for a vehicle in the above embodiment. However, the present disclosure is not limited to the above case and the refrigerant evaporator 1 may be applied to a refrigerating cycle used in, for example, a water heater instead.

The embodiments above have described a case where the second partition member 14 is disposed inside the first windward tank portion 12 at the center portion in the tube longitudinal direction. However, the present disclosure is not limited to the case described above. The second partition member 14 may be disposed at an arbitrary position in a region more on the opposite side to the windward heat-exchanging core portion 11 than the ends of the tubes 111 in the longitudinal direction.

The embodiments above have described a case where the first partition member 24 is disposed inside the first leeward tank portion 22 at the center position in the tube longitudinal direction. However, the present disclosure is not limited to the case described above. The first partition member 24 may be disposed at an arbitrary position in a region more on the opposite side to the leeward heat-exchanging core portion 21 than the ends of the tubes 211 in the longitudinal direction.

The first embodiment above has described an example of the case where the first communication holes 241 and the second communication holes 141 are disposed at positions so as not to overlap when viewed in the flow direction X of blown air. According to the example, one first communication hole 241 is provided in the vicinity of each end of the first partition member 24 in the tube stacking direction and three second communication holes 141 are provided at or near the center of the second partition member 14 in the tube stacking direction. However, the configurations of the first communication holes 241 and the second communication holes 141 are not limited to the configuration described above.

Figure 9:
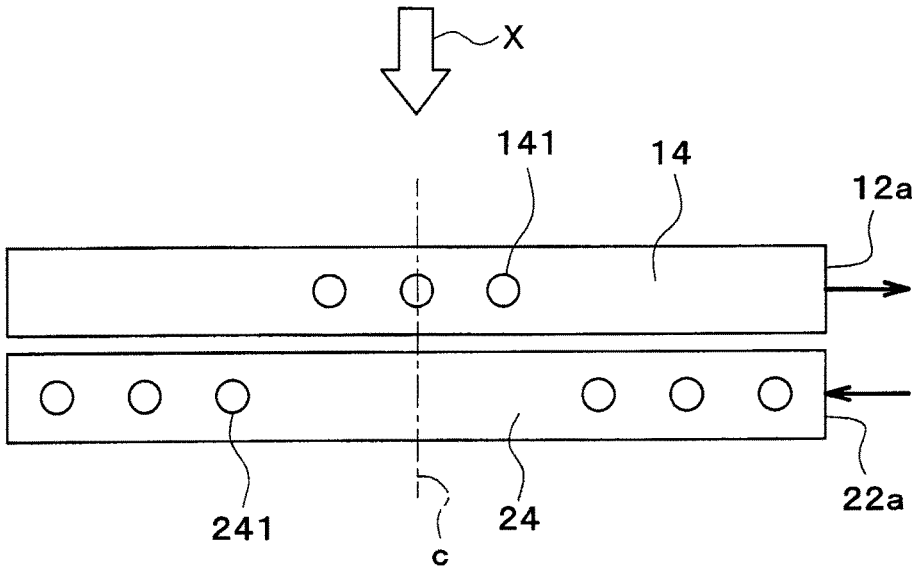
FIG. 9 is a view to describe a first partition member and a second partition member of a refrigerant evaporator according to a modification of the first embodiment.

For example, as shown in FIG. 9, it may be configured in such a manner that three first communication holes 241 are provided in the vicinity of each end of the first partition member 24 in the tube stacking direction and three second communication holes 141 are provided at or near the center of the second partition member 14 in the tube stacking direction. Herein, both of the first communication holes 241 and the second communication holes 141 are disposed symmetrically with respect to a center line c of the first partition member 24 and the second partition member 14 in the tube stacking direction.

Figure 10:
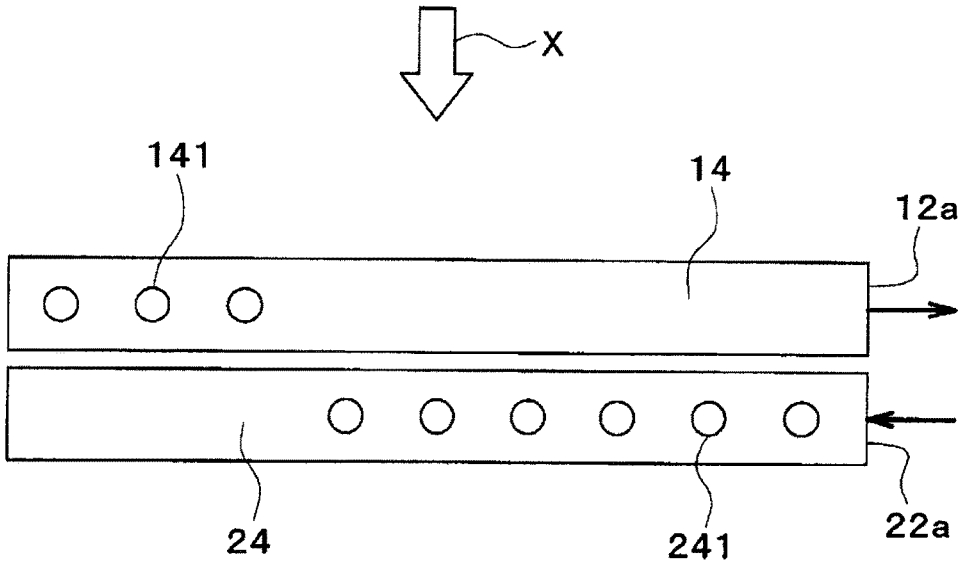
FIG. 10 is a view to describe a first partition member and a second partition member of a refrigerant evaporator according another modification of the first embodiment.

Alternatively, as shown in FIG. 10, it may be configured in such a manner that the second communication holes 141 are provided at an end of the second partition member 14 in the tube stacking direction on the side away from the refrigerant outlet portion 12*a* and multiple first communication holes 241 are provided at regular intervals at positions so as not to overlap the second communication holes 141 when viewed in the flow direction X of blown air.

The second embodiment above has described an example of the case where the first communication holes 241*a*, which are a part of the multiple first communication holes 241, are disposed at positions so as to overlap the second communication holes 141 when viewed in the flow direction X of blown air and the first communication holes 241*b*, which are the rest of the multiple first communication holes 241, are disposed at positions so as not to overlap the second communication holes 141 when viewed in the flow direction X of blown air. According to the example, both of the first communication holes 241 and the second communication holes 141 are disposed symmetrically with respect to the center line c of the first partition member 24 and the second partition member 14 in the tube stacking direction. However, the configurations of the first communication holes 241 and the second communication holes 141 are not limited to the configuration described above.

Figure 11:
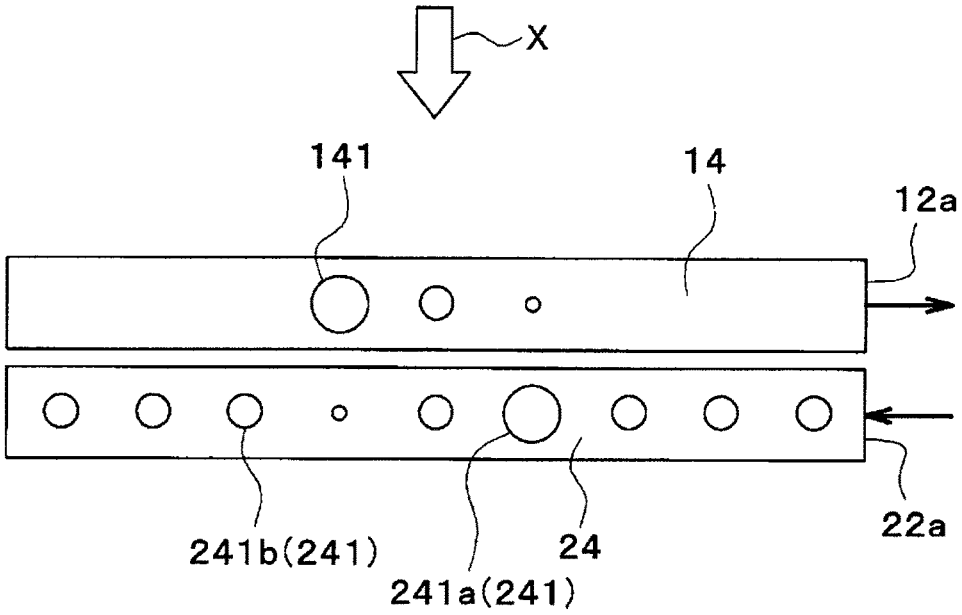
FIG. 11 is a view to describe a first partition member and a second partition member of a refrigerant evaporator according to a modification of the second embodiment.

For example, as shown in FIG. 11, it may be configured in such a manner that multiple first communication holes 241 having different diameters are provided across the entire first partition member 24 in the tube stacking direction and multiple second communication holes 141 each having a different diameter are provided at or near the center of the second partition member 14 in the tube stacking direction.

What is claimed is:

1. A refrigerant evaporator that exchanges heat between fluid flowing outside to be cooled and refrigerant, comprising a first evaporation unit and a second evaporation unit disposed in series in a flow direction of the fluid, wherein:

each of the first evaporation unit and the second evaporation unit has a heat-exchanging core portion in which a plurality of tubes are stacked, the refrigerant flowing through the plurality of tubes, and a pair of tank portions connected to both ends of the plurality of tubes to collect or distribute the refrigerant flowing inside the plurality of tubes;

the heat-exchanging core portion of the first evaporation unit has a first core portion defined by a part of the plurality of tubes of the first evaporation unit and a second core portion defined by a rest of the plurality of tubes of the first evaporation unit;

the heat-exchanging core portion of the second evaporation unit has a third core portion defined by a part of the plurality of tubes of the second evaporation unit opposing at least a part of the first core portion in the flow direction of the fluid and a forth core portion defined by a rest of the plurality of tubes of the second evaporation unit opposing at least a part of the second core portion in the flow direction of the fluid;

of the pair of tank portions of the first evaporation unit, one tank portion includes a first refrigerant collection portion to collect the refrigerant from the first core portion and a second refrigerant collection portion to collect the refrigerant from the second core portion;

of the pair of tank portions of the second evaporation unit, one tank portion includes a first refrigerant distribution portion to distribute the refrigerant to the third core portion and a second refrigerant distribution portion to distribute the refrigerant to the fourth core portion;

the first evaporation unit and the second evaporation unit are coupled via a refrigerant interchanging portion having a first communication portion that introduces refrigerant from the first refrigerant collection portion to the second refrigerant distribution portion and a second communication portion that introduces refrigerant from the second refrigerant collection portion to the first refrigerant distribution portion;

the first evaporation unit has a refrigerant inlet portion through which refrigerant is introduced into the other tank portion of the first evaporation unit at an end of the other tank portion in a stacking direction of the tubes;

the other tank portion of the first evaporation unit includes a dam portion to stop a flow of liquid phase refrigerant that has flowed into the other tank portion from the refrigerant inlet portion; and the dam portion is located at a position so as to overlap a boundary between the third core portion and the fourth core portion of the second evaporation unit when viewed in the flow direction of the fluid; wherein the dam portion is defined by a disc plate, and an outer peripheral surface of the disc plate is bonded to an inner peripheral surface of the other tank portion of the first evaporation unit, the disc plate has a through-hole disposed on an upper side of a center portion of the disc plate in a longitudinal direction of the tubes, the dam portion defined by a lower side of the through-hole to stop the flow of liquid phase refrigerant, and a protrusion portion defined by an upper side of the through-hole to drop the liquid phase refrigerant scattered when flowing inside from the refrigerant inlet portion.

2. The refrigerant evaporator according to claim 1, wherein:

the disc plate is disposed to protrude from a lower side of the inner peripheral surface of the other tank portion adjacent to the heat-exchanging core portion of the first evaporation unit.

3. The refrigerant evaporator according to claim 1, wherein:

the other tank portion of the first evaporation unit has an upper side of the inner peripheral surface opposite to the heat-exchanging core portion through longitudinal ends of the plurality of tubes of the first evaporation unit, and the upper side of the inner peripheral surface includes the protrusion portion protruding toward the heat-exchanging core portion; and the protrusion portion is disposed at a position so as to overlap the boundary between the third core portion and the fourth core portion of the second evaporation unit when viewed in the flow direction of the fluid.

4. The refrigerant evaporator according to claim 1, wherein:

the first evaporation unit and the second evaporation unit are disposed in such a manner that a longitudinal direction of the tube crosses a horizontal direction.

5. A refrigerant evaporator that exchanges heat between fluid flowing outside to be cooled and refrigerant, comprising a first evaporation unit and a second evaporation unit disposed in series in a flow direction of the fluid, wherein:

each of the first evaporation unit and the second evaporation unit has a heat-exchanging core portion in which a plurality of tubes are stacked, the refrigerant flowing through the plurality of tubes, and a pair of tank portions connected to both ends of the plurality of tubes to collect or distribute the refrigerant flowing inside the plurality of tubes;

the heat-exchanging core portion of the first evaporation unit has a first core portion defined by a part of the plurality of tubes of the first evaporation unit and a second core portion defined by a rest of the plurality of tubes of the first evaporation unit;

the heat-exchanging core portion of the second evaporation unit has a third core portion defined by a part of the plurality of tubes of the second evaporation unit opposing at least a part of the first core portion in the flow direction of the fluid and a forth core portion defined by a rest of the plurality of tubes of the second evaporation unit opposing at least a part of the second core portion in the flow direction of the fluid;

of the pair of tank portions of the first evaporation unit, one tank portion includes a first refrigerant collection portion to collect the refrigerant from the first core portion and a second refrigerant collection portion to collect the refrigerant from the second core portion;

of the pair of tank portions of the second evaporation unit, one tank portion includes a first refrigerant distribution portion to distribute the refrigerant to the third core portion and a second refrigerant distribution portion to distribute the refrigerant to the fourth core portion;

the first evaporation unit and the second evaporation unit are coupled via a refrigerant interchanging portion having a first communication portion that introduces refrigerant from the first refrigerant collection portion to the second refrigerant distribution portion and a second communication portion that introduces refrigerant from the second refrigerant collection portion to the first refrigerant distribution portion;

the first evaporation unit has a refrigerant inlet portion through which refrigerant is introduced into the other tank portion of the first evaporation unit at an end of the other tank portion in a stacking direction of the tubes;

the other tank portion of the first evaporation unit includes a dam portion to stop a flow of liquid phase refrigerant that has flowed into the other tank portion from the refrigerant inlet portion; and the dam portion is located at a position so as to overlap a boundary between the third core portion and the fourth core portion of the second evaporation unit when viewed in the flow direction of the fluid, wherein the dam portion is defined by a boundary tube that is only one of the tubes of the first evaporation unit disposed at a position nearest to the boundary, and an upper end of the boundary tube protrudes to an upper side more than upper ends of the other tubes of the first evaporation unit.

6. The refrigerant evaporator according to claim 5, wherein:

the first evaporation unit and the second evaporation unit are disposed in such a manner that a longitudinal direction of the tube crosses a horizontal direction.

7. A refrigerant evaporator that exchanges heat between fluid flowing outside to be cooled and refrigerant, comprising a first evaporation unit and a second evaporation unit disposed in series in a flow direction of the fluid, wherein:

each of the first evaporation unit and the second evaporation unit has a heat-exchanging core portion in which a plurality of tubes are stacked, the refrigerant flowing through the plurality of tubes, and a pair of tank portions connected to both ends of the plurality of tubes to collect or distribute the refrigerant flowing inside the plurality of tubes;

the heat-exchanging core portion of the first evaporation unit has a first core portion defined by a part of the plurality of tubes of the first evaporation unit and a second core portion defined by a rest of the plurality of tubes of the first evaporation unit;

the heat-exchanging core portion of the second evaporation unit has a third core portion defined by a part of the plurality of tubes of the second evaporation unit opposing at least a part of the first core portion in the flow direction of the fluid and a forth core portion defined by a rest of the plurality of tubes of the second evaporation unit opposing at least a part of the second core portion in the flow direction of the fluid;

of the pair of tank portions of the first evaporation unit, one tank portion includes a first refrigerant collection portion to collect the refrigerant from the first core portion and a second refrigerant collection portion to collect the refrigerant from the second core portion;

of the pair of tank portions of the second evaporation unit, one tank portion includes a first refrigerant distribution portion to distribute the refrigerant to the third core portion and a second refrigerant distribution portion to distribute the refrigerant to the fourth core portion;

the first evaporation unit and the second evaporation unit are coupled via a refrigerant interchanging portion having a first communication portion that introduces refrigerant from the first refrigerant collection portion to the second refrigerant distribution portion and a second communication portion that introduces refrigerant from the second refrigerant collection portion to the first refrigerant distribution portion;

the first evaporation unit has a refrigerant inlet portion through which refrigerant is introduced into the other tank portion of the first evaporation unit at an end of the other tank portion in a stacking direction of the tubes;

the other tank portion of the first evaporation unit includes a dam portion to stop a flow of liquid phase refrigerant that has flowed into the other tank portion from the refrigerant inlet portion; and the dam portion is located at a position so as to overlap a boundary between the third core portion and the fourth core portion of the second evaporation unit when viewed in the flow direction of the fluid, wherein the dam portion is defined by a convex part of the other tank portion of the first evaporation unit protruding inside along an entire periphery of the other tank portion at the boundary, and the convex part has a first convex portion positioned near the heat-exchanging core portion to stop the flow of liquid phase refrigerant, and a second convex portion positioned opposite to the heat-exchanging core portion to drop the liquid phase refrigerant scattered when flowing inside from the refrigerant inlet portion.

8. The refrigerant evaporator according to claim 7, wherein:

the other tank portion of the first evaporation unit has a surface opposite to the heat-exchanging core portion through longitudinal ends of the plurality of tubes of the first evaporation unit, and the surface has a protrusion portion protruding toward the heat-exchanging core portion; and the protrusion portion is disposed at a position so as to overlap the boundary between the third core portion and the fourth core portion of the second evaporation unit when viewed in the flow direction of the fluid.

9. The refrigerant evaporator according to claim 7, wherein:

the first evaporation unit and the second evaporation unit are disposed in such a manner that a longitudinal direction of the tube crosses a horizontal direction.

* * * * *